US011745967B2

(12) United States Patent
Togano et al.

(10) Patent No.: US 11,745,967 B2
(45) Date of Patent: Sep. 5, 2023

(54) PAPER FEED TRAY, PAPER FEED DEVICE, AND CIRCULATION-TYPE PAPER SHEET PROCESSING DEVICE

(71) Applicant: JAPAN CASH MACHINE CO., LTD., Osaka (JP)

(72) Inventors: Keiichi Togano, Osaka (JP); Shinya Izawa, Osaka (JP)

(73) Assignee: JAPAN CASH MACHINE CO., LTD., Osaka (JP)

( * ) Notice: Subject to any disclaimer, the term of this patent is extended or adjusted under 35 U.S.C. 154(b) by 245 days.

(21) Appl. No.: 17/043,590

(22) PCT Filed: Jan. 9, 2019

(86) PCT No.: PCT/JP2019/000329
§ 371 (c)(1),
(2) Date: Sep. 29, 2020

(87) PCT Pub. No.: WO2019/187481
PCT Pub. Date: Oct. 3, 2019

(65) Prior Publication Data

US 2021/0024308 A1 Jan. 28, 2021

(30) Foreign Application Priority Data

Mar. 30, 2018 (JP) ..... 2018-067634

(51) Int. Cl.
*B65H 5/26* (2006.01)
*B65H 1/26* (2006.01)
(Continued)

(52) U.S. Cl.
CPC ..... *B65H 1/266* (2013.01); *B65H 3/06* (2013.01); *B65H 5/26* (2013.01); *G07D 11/245* (2019.01);
(Continued)

(58) Field of Classification Search
CPC ..... B65H 5/26; B65H 1/266; B65H 2405/332
See application file for complete search history.

(56) References Cited

U.S. PATENT DOCUMENTS 5,287,164 A * 2/1994 Watanabe ..... B65H 1/266 271/145
7,694,950 B2 * 4/2010 Shiohara ..... B65H 1/22 271/9.01
(Continued)

FOREIGN PATENT DOCUMENTS

CN 101952859 A 1/2011
JP S61-98738 U 6/1986
(Continued)

OTHER PUBLICATIONS

WIPO, Japanese International Search Authority, International Search Report and Written Opinion (with English translation) dated Feb. 12, 2019 in International Patent Application No. PCT/JP2019/000329, 8 pages.
(Continued)

*Primary Examiner* — Howard J Sanders
(74) *Attorney, Agent, or Firm* — Masuvalley & Partners; Peter R. Martinez

(57) ABSTRACT

Provided is a paper sheet replenishing box (paper feed device) for replenishing reserve fund in each circulation-type paper sheet storage unit, wherein paper sheets of each denomination can be replenished from one paper sheet replenishing box in which paper sheets of different denominations having different sizes are accommodated together to a circulation unit of the respective circulation-type paper sheet storage units. The paper sheet replenishing box includes a first tray piece 201 in which a plurality of pieces of first paper sheets P1 are placed in a stacked state, a second tray piece 211 arranged immediately below the first tray piece, on which a plurality of pieces of second paper sheets
(Continued)

P2 having a different longitudinal dimension from that of the first paper sheet are placed in a stacked state, and rear-end regulating members 204 and 214 that align front end positions in a transport direction of respective paper sheet bundles to predetermined positions. After all the first paper sheets in a bundle on the first tray piece have been fed by a feed unit 160, an uppermost surface of the second paper sheets in a bundle on the second tray piece becomes a state capable of coming in contact with the feed unit.

6 Claims, 16 Drawing Sheets

(51) Int. Cl.

| | |
|---|---|
| ***G07D 11/245*** | (2019.01) |
| ***B65H 3/06*** | (2006.01) |
| *G07D 11/17* | (2019.01) |
| *G07D 11/14* | (2019.01) |
| *G07D 7/04* | (2016.01) |
| *G07D 7/12* | (2016.01) |

(52) U.S. Cl.
CPC ..... *G07D 7/04* (2013.01); *G07D 7/12* (2013.01); *G07D 11/14* (2019.01); *G07D 11/17* (2019.01); *G07D 2207/00* (2013.01); *G07D 2211/00* (2013.01)

(56) References Cited

U.S. PATENT DOCUMENTS

| | | | | |
|---|---|---|---|---|
| 8,727,334 | B2 * | 5/2014 | Nunokawa | B65H 3/44 271/9.03 |
| 2010/0218707 | A1 | 9/2010 | Billet et al. | |
| 2022/0009735 | A1 * | 1/2022 | Nitta | B65H 5/38 |

FOREIGN PATENT DOCUMENTS

| | | | |
|---|---|---|---|
| JP | H09-58882 | A | 3/1997 |
| JP | 2000-044074 | A | 2/2000 |
| JP | 2016-050067 | A | 4/2016 |
| JP | 2016-218965 | A | 12/2016 |

OTHER PUBLICATIONS

Extended European Search Report issued in EP19775517.6 dated Nov. 25, 2021 (7 pages).
Intellectual Property India, Indian Office Action (with English translation) dated Jun. 30, 2021 in Indian Application No. 202037041724, 7 pages.

* cited by examiner

PAPER FEED TRAY, PAPER FEED DEVICE, AND CIRCULATION-TYPE PAPER SHEET PROCESSING DEVICE

RELATED APPLICATIONS

This application is the U.S. National Phase of and claims priority to International Patent Application No. PCT/JP2019/000329, International Filing Date Jan. 9, 2019, entitled Paper Supply Tray, Paper Supply Device, And Circulation Type Paper Sheet Processing Device; which claims priority to Japanese Application No. 2018-067634 filed Mar. 30, 2018; both of which are incorporated herein by reference in their entireties.

FIELD

The present invention relates to improvement of a paper feed device to be used for replenishing paper sheets to each circulation unit at the opening time or the like, in a paper sheet processing device including a circulation-type paper sheet storage unit that accommodates paper sheets by each type.

BACKGROUND

As a banknote processing device installed in a banknote handling device such as a vending machine having a function of providing various articles and services by receiving an input banknote, a game-medium lending machine in a game hall, a ticket machine, a cash machine, and a money changer, a circulation-type banknote processing device capable of receiving, storing, and dispensing banknotes of a plurality of denominations has been known.

The circulation-type banknote processing device is provided with a banknote storage unit for storing therein banknotes prepared for payout beforehand and banknotes input during operation by denomination, or in a state of mixed denominations.

As described in a "banknote handling device" in Patent Literature 1, as a banknote storage unit, there is a circulation-type banknote storage unit including a function of storing banknotes while discharging banknotes as change to outside, and a collected banknote storage unit (a collection box) that collects all the banknotes in the banknote processing device at the closing time or the like.

Since it is required to replenish banknotes as a reserve fund at the opening time or the like in the circulation-type banknote storage unit, a replenishing operation using a banknote replenishing box including a paper feed function is performed with respect to the circulation-type banknote storage unit.

The banknote processing device includes a plurality of attachment spaces for attaching and detaching the circulation-type banknote storage unit, and the banknote replenishing box is temporarily attached to the attachment space that is formed by detaching one circulation-type banknote storage unit to perform a paper feed operation, thereby automatically performing replenishment of banknotes for payout in the other circulation-type banknote storage units.

To maintain the paper feed performance by the banknote replenishing box appropriately, the specification is required to be such that the size of a banknote setting unit and the position or the like of a paper feed roller group are adapted for one denomination. Meanwhile, since the banknotes have different sizes for each denomination, it is necessary to design and prepare the banknote replenishing box for each denomination. In other words, it is difficult to design the banknote replenishing box in such a manner that banknotes having different sizes are mixed and set in one banknote replenishing box, and the conventional banknote replenishing box can store only one type of denomination.

In this manner, since the conventional banknote replenishing box can store only one denomination, even if a plurality of circulation-type banknote storage units that store therein banknotes of different denominations are installed in one banknote processing device, it has been possible to perform replenishment to only one circulation-type banknote storage unit in a replenishing operation from one banknote replenishing box. Therefore, after completion of a replenishing operation for one denomination, in order to perform a replenishing operation to another circulation-type banknote storage unit that stores therein another denomination, it is necessary to perform the replenishing operation by re-installing another banknote replenishing box that stores therein the other denomination, thereby deteriorating the workability. Since it has been necessary to prepare banknote replenishing boxes for the number of denominations, there are disadvantages in increasing the cost and management work.

When two circulation units that store therein banknotes by denomination are installed in one circulation-type banknote storage unit as in the banknote handling device in Patent Literature 1, it is also necessary to perform an operation by detaching and replacing the replenishing box for each denomination.

CITATION LIST

Patent Literature

Patent Literature 1: Japanese Patent Application Laid-open No. 2016-218965

SUMMARY

Technical Problem

The present invention has been achieved in view of the problems described above, and an object of the present invention is to provide a technique in a paper feed device (a paper sheet replenishing box) for replenishing reserve paper sheets to each of a plurality of circulation-type paper sheet storage units in a circulation-type paper sheet processing device including the circulation-type paper sheet storage units, which enables to replenish various types of paper sheets continuously from one paper sheet replenishing box that accommodates together therein different types of paper sheets having different sizes with respect to the circulation-type paper sheet storage units.

Solution to Problem

In order to achieve the above object, a paper feed tray according to the present invention is a paper feed tray attached to a paper feed device including a feed unit that feeds paper sheets one by one by coming in contact with an upper surface of a paper sheet and rotating, the paper feed tray comprising: at least a first tray piece on which a plurality of pieces of first paper sheets are placed in a stacked state; a second tray piece arranged immediately below the first tray piece, on which a plurality of pieces of second paper sheets having a different longitudinal dimension from that of the first paper sheet are placed in a stacked state; rear-end regulating members that respectively regulate rear end positions in a transport direction of a bundle of the first paper sheets and a bundle of the second paper sheets to align front end positions in the transport direction of respective paper sheet bundles to predetermined positions; and a width-direction regulating member that regulates positions in a width direction of the bundle of the first paper sheets and the bundle of the second paper sheets, wherein after all the first paper sheets in a bundle on the first tray piece have been fed by the feed unit, an uppermost surface of the second paper sheets in a bundle on the second tray piece becomes a state capable of coming in contact with the feed unit.

Advantageous Effects of Invention

According to the present invention, it is possible to replenish various types of paper sheets continuously from one paper sheet replenishing box that accommodates together therein different types of paper sheets having different sizes with respect to each circulation-type paper sheet storage unit.

DESCRIPTION OF EMBODIMENTS

Figure 1A:
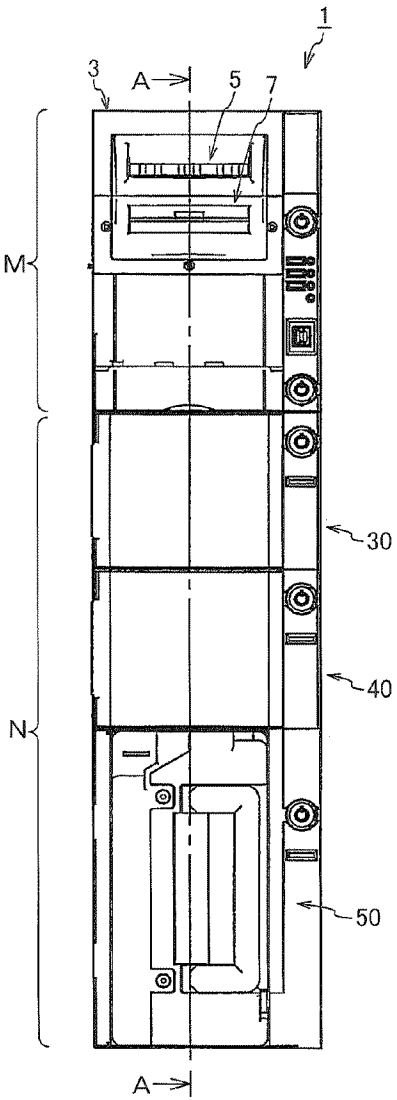
FIGS. 1(*a*) and (*b*) are respectively a front elevation and an A-A sectional view of a banknote (paper sheet) processing device including a paper sheet storage unit according to one embodiment of the present invention.

The present invention will be described below in detail with embodiments illustrated in the drawings.

[Configuration of Banknote Processing Device]

Figure 1B:
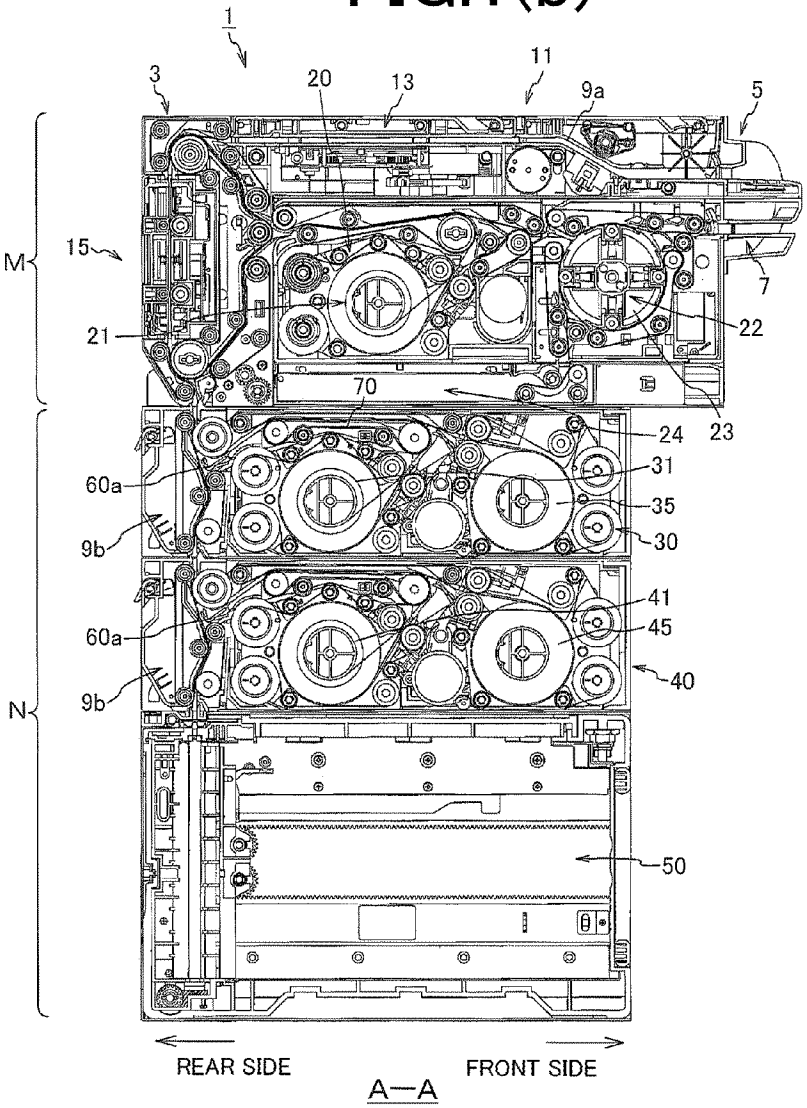

FIGS. 1(*a*) and (*b*) are respectively a front elevation and an A-A sectional view of a banknote (paper sheet) processing device including a paper sheet storage unit according to one embodiment of the present invention.

In the present embodiment, although a device that processes banknotes as an example of paper sheets is described, the paper sheet storage unit and the paper sheet processing device illustrated in the drawings can be also applied to a processing device of other paper sheets such as cash vouchers, tickets, and marketable securities, other than banknotes.

A circulation-type banknote processing device (hereinafter, "banknote processing device") 1 illustrated in FIG. 1 is a unit that is installed in or together with a banknote handling device, for example, a vending machine, a ticket machine, a game-medium lending machine in a game hall, a cash machine, or a money changer, to receive banknotes and dispense banknotes as change or the like.

Figure 2A:
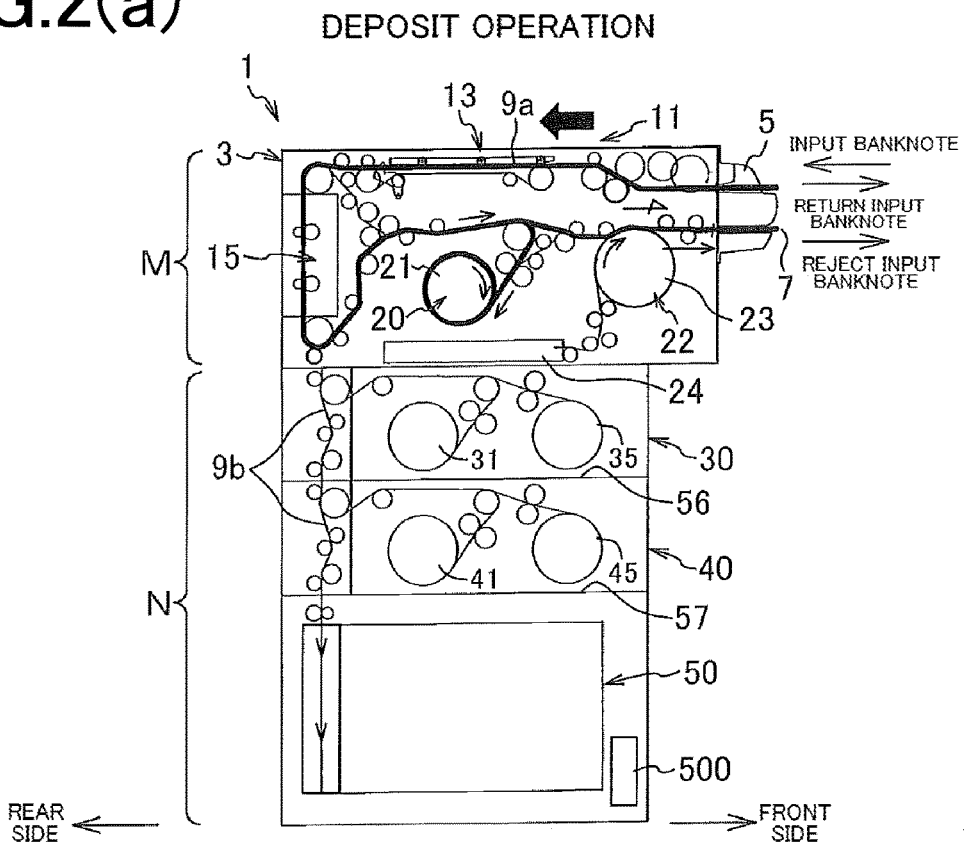
FIGS. 2(*a*) and (*b*) are explanatory diagrams of a deposit operation and a confirmation operation of the banknote processing device.
Figure 2B:
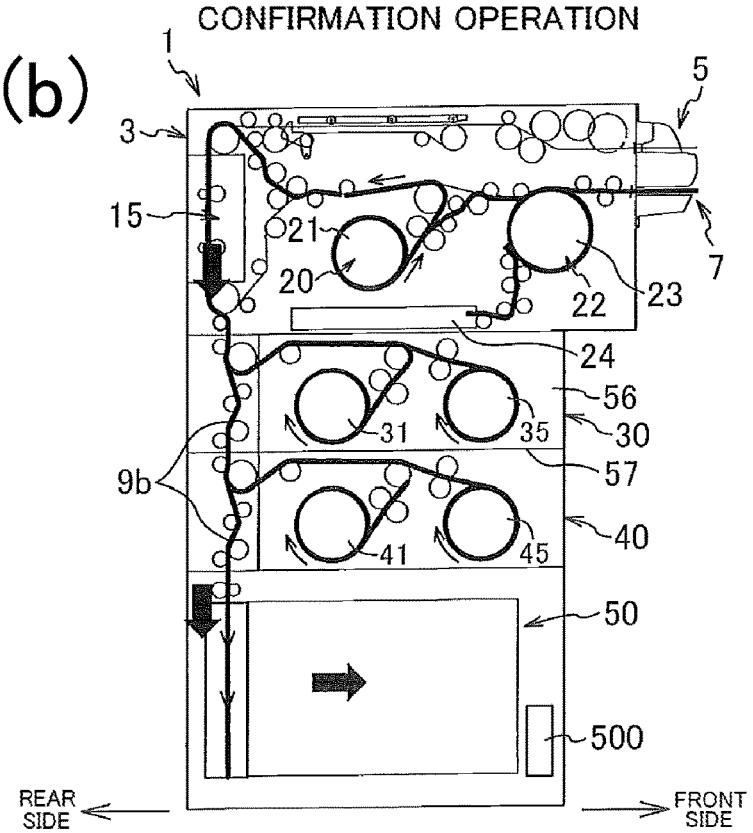
Figure 3A:
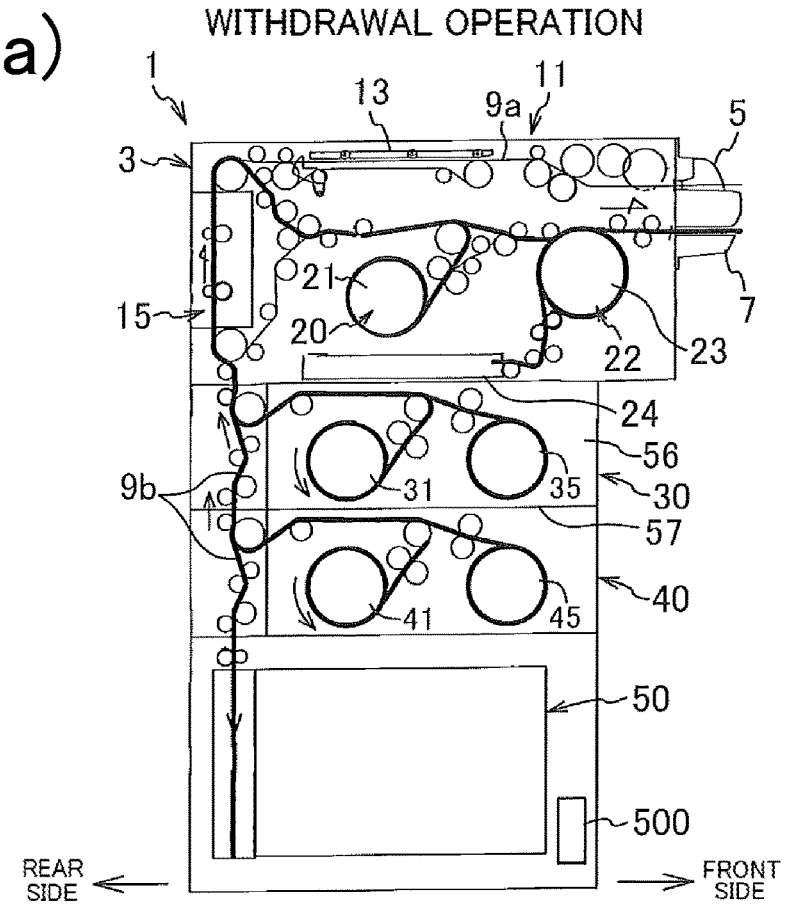
FIGS. 3(*a*) and (*b*) are explanatory diagrams of a withdrawal operation and a collection operation of the banknote processing device.
Figure 3B:
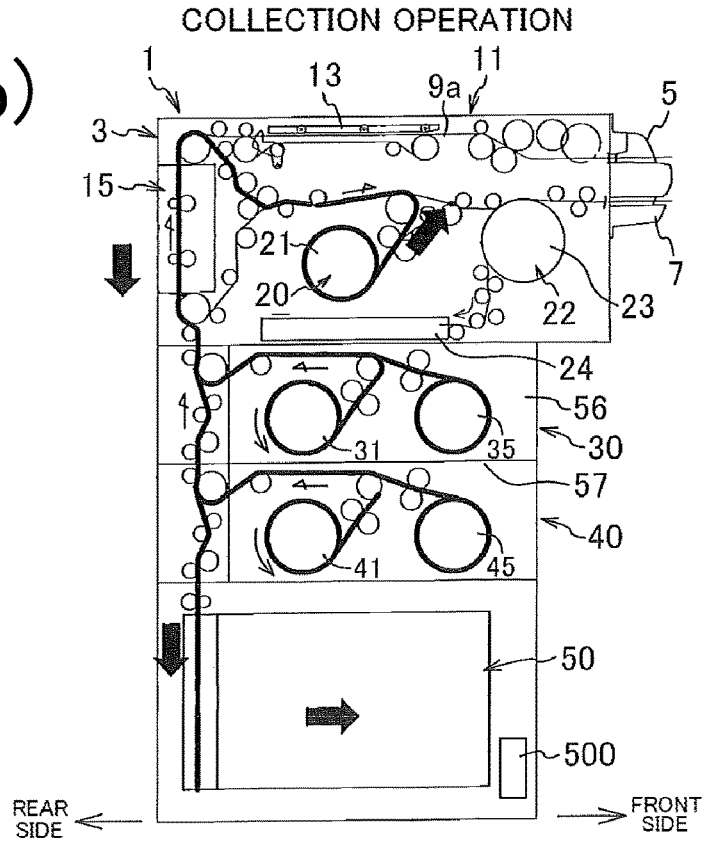
Figure 4:
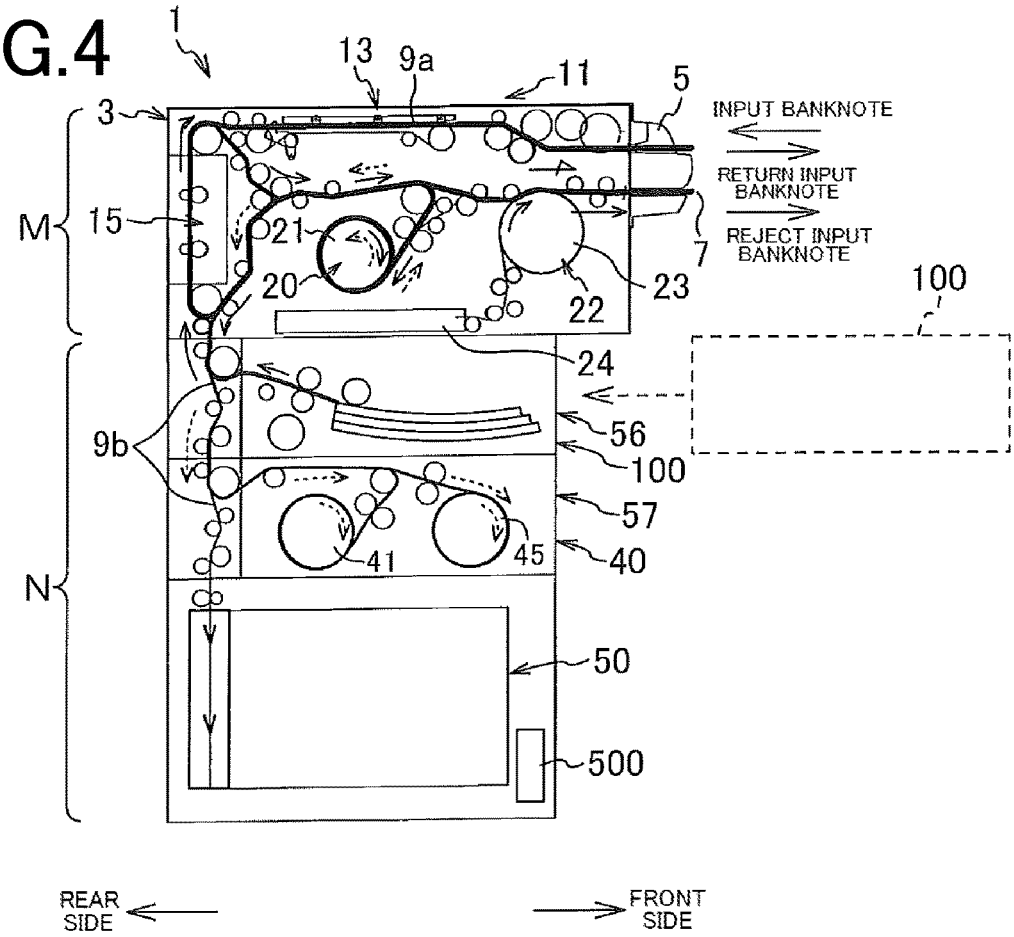
FIG. 4 is an explanatory diagram of a replenishing operation in a banknote replenishing box.

The banknote processing device 1 is schematically constituted by a housing 3 constituting an exterior body, a deposit and withdrawal processing unit M that transports a banknote inserted into the housing in a required route in the machine and discharges a banknote to outside, a banknote storage unit N that stores therein a banknote transported from the deposit and withdrawal processing unit M and transfers banknotes between the deposit and withdrawal processing unit M and the banknote storage unit N, a transport mechanism that transports banknotes through various routes, and a control unit (a CPU, an MPU, a ROM, a RAM, or the like) 500 that controls various control targets (FIGS. 2 to FIG. 4).

The deposit and withdrawal processing unit M includes an input/output port 5 that collectively receives a bundle of banknotes up to 30 sheets including banknotes of different denominations and becomes a return port at the time of returning input banknotes, a return port 7 that becomes a dispensing port of banknotes up to 30 sheets and an input-rejection return port, and a collective deposit unit 11 that separates a bundle of banknotes input and set in the input/ output port 5 from each other and introduces each banknote into a device body along an input-banknote transport route 9*a*. The deposit and withdrawal processing unit M also includes a centering unit 13 arranged on a downstream side of the collective deposit unit 11 to align the position in a width direction of a transported banknote to the center of a transport route, a recognition unit 15 arranged on a downstream side of the centering unit to judge the denomination and the authenticity of the input banknote by using an optical sensor and a magnetic sensor together, an escrow unit (temporary holding unit) 20 that temporarily holds the input banknotes having passed the recognition unit up to 30 sheets, and after acceptance is confirmed, feeds the banknote to each of a storage unit and a collection box described later, or at the time of cancellation and return due to a return request or the like, feeds the banknote to a payout stacking unit (payout stacking device) 22, and the payout stacking unit (stacking device of returned banknotes) 22 that once stacks banknotes to be returned or rejected banknotes transported from the escrow unit (hereinafter, "returned banknote"), and then discharges the banknotes to the return port 7. Further, the deposit and withdrawal processing unit M includes a forgotten-banknote storage unit (banknote holding unit) 24 in which, when a returned banknote paid out from the payout stacking unit 22 to the return port 7 is not collected by a customer even after a predetermined time has passed, the banknote is transported in a reverse direction by the payout stacking unit and stored therein as a forgotten banknote.

The banknote storage unit N includes first and second circulation-type banknote storage units (circulation-type banknote storage devices) 30 and 40 that accumulate banknotes fed from the escrow unit 20 one by one when acceptance of the input banknotes is confirmed, and transported on respective transport routes 9*a* and 9*b* for each denomination so that the banknotes can be taken in and out, and a collection box (collected-banknote storage unit) 50 detachably attached into an accommodation space provided below the second circulation-type banknote storage unit 40 from a front side, to collect all denominations of banknotes from each circulation-type banknote storage unit at the closing time or the like, and collect high-denomination banknotes that are not used as change and excessive banknotes that cannot be accommodated in each circulation-type banknote storage unit.

The transport mechanism includes a motor, a solenoid, and a pulley for generating and transmitting a drive force for transporting banknotes along the respective transport routes 9*a* and 9*b* and other transport routes, a belt, a gate, and the like.

A control unit 500 controls control targets such as the deposit and withdrawal processing unit M, the banknote storage unit N, the transport mechanism, and the like.

The maximum number of banknotes to be handled in the input/output port 5 and the return port 7 is only an example.

The first and second circulation-type banknote storage units 30 and 40 in the present example respectively include two circulation drums (31, 35, 41, and 45) respectively having the maximum storage number of 60 sheets. The respective circulation drums 31, 35, 41, and 45 are of a type suitable for circulation in which a banknote is stored between two long tapes (long films) overlapped and spirally (helically) wound around respective outer peripheries of these drums.

[Various Operations of Banknote Processing Device]

Next, an outline of a deposit operation, a confirmation operation, a withdrawal operation, a collection operation, and a replenishing operation in the banknote processing device 1 to which the banknote storage device illustrated in FIG. 1 is applied is described with reference to FIGS. 2, FIG. 3, and FIG. 4.

That is, FIGS. 2(*a*) and (*b*) are explanatory diagrams of the deposit operation and the confirmation operation of the banknote processing device, FIGS. 3(*a*) and (*b*) are explanatory diagrams of the withdrawal operation and the collection operation of the banknote processing device, and FIG. 4 is an explanatory diagram of the replenishing operation.

First, in the deposit operation in FIG. 2(*a*), when one or a plurality of sheets of banknotes are input from the input/output port 5, upon reception of a signal from a sensor having detected the banknote, the control unit 500 activates the transport mechanism to take in the banknotes by using the collective deposit unit 11 and the input-banknote transport route 9*a*. The collective deposit unit 11 extracts the banknote one by one from the uppermost banknote in the bundle of banknotes set in the input/output port 5, and transports the extracted banknote to the centering unit 13. The banknote subjected to centering by the centering unit is moved to the recognition unit 15 to be recognized. The banknote judged to be acceptable by the recognition unit 15 is transported to the escrow unit 20, in which the banknotes are wound one by one around an outer periphery of an escrow drum 21 and temporarily held, to wait for confirmation of the deposit. If a rejected banknote, which is judged to be unacceptable in the recognition unit, is a banknote input one by one from the input/output port 5, the banknote is directly discharged to outside from the return port 7. Meanwhile, when a plurality of banknotes collectively input are rejected, the banknotes are once stacked (one to plural sheets) in the payout stacking unit 22, and then are discharged to outside and returned collectively from the return port 7. Further, when a customer requests return of banknotes by operating a cancel button (not illustrated), the banknotes temporarily held in the escrow unit 20 are fed to the payout stacking unit 22 one by one, overlapped one by one and wound on an outer periphery of a rotating payout drum 23, and are stacked in a laminated state. When stacking of all the banknotes input by the customer on the outer periphery of the payout drum is completed, the payout drum 23 rotates in a payout direction, to cause the bundle of banknotes to project outside and be returned from the return port 7, thereby prompting the customer to receive the banknotes.

If the bundle of banknotes projected to outside for return from the return port 7 are not collected by the customer even after a predetermined time has passed, the payout drum is reversely rotated in a return direction to transport the banknotes into the machine, and stored as forgotten banknotes in the forgotten-banknote storage unit 24.

In the confirmation operation in FIG. 2(*b*), when deposit of the input banknotes temporarily held in the escrow unit 20 is confirmed, the banknotes are fed out one by one from the escrow unit, and banknotes to be used as change are stored in either one of the circulation-type banknote storage units 30 and 40 by denomination via the stored-banknote transport route 9*b*, and banknotes not to be used as change are stored in the collection box 50.

In the withdrawal operation in FIG. 3(*a*), banknotes stored in the circulation-type banknote storage units 30 and 40 are extracted and recognized in the recognition unit 15 at the time of dispensing the banknote as change, and if the banknote is a banknote capable of being returned, the banknote is once stacked (one to plural sheets) in the payout stacking unit 22, and paid out collectively as change from the return port 7.

On the other hand, when it is judged that the banknote is a banknote that cannot be returned by the recognition of the recognition unit 15, the banknote is temporarily held in the escrow unit 20, and then transferred to the collection box 50 to be stored therein.

In the collection operation in FIG. 3(*b*), the banknotes stored in the circulation-type banknote storage units (circulation-type banknote storage devices) 30 and 40 at the closing time or the like are once stacked in the escrow unit 20, and then stored in the collection box 50.

Next, an operation procedure of replenishing banknotes is described with reference to FIG. 4.

The banknote storage unit N includes a plurality of stages of attachment spaces (attachment sections) 56 and 57 for attaching and detaching the circulation-type banknote storage units 30 and 40, and it is required to store beforehand banknotes as reserve fund at the opening time or the like in the respective circulation-type banknote storage units 30 and 40.

When replenishing reserve fund with respect to each circulation-type banknote storage unit, by attaching a storage (a banknote replenishing box) 100 for replenishing banknotes in which the reserve fund is filled, into the attachment section 56 that has become empty by detaching one circulation-type banknote storage unit 30, a replenishing operation is performed to feed the reserve fund by denomination to the other circulation-type banknote storage unit 40 attached to the other attachment section 57 according to a predetermined procedure.

That is, the banknotes fed from the banknote replenishing box 100 is once fed to the recognition unit 15, and subjected to recognition for authenticity, denomination, and the like. Only the banknotes capable of being used as change are sequentially transferred to the escrow unit 20, and when staking of the banknotes on the outer periphery of the escrow drum 21 is completed, the banknotes are sequentially fed to a circulation-type banknote storage unit corresponding to each denomination. A banknote judged to be unusable as change is fed to the collection box 50.

Since all the banknotes fed to the escrow unit from the banknote replenishing box have been recognized, the control unit 500 ascertains which banknote stacked on the outer periphery of the escrow drum is of which denomination, and can feed the banknotes of the corresponding denomination to each of circulation drums 41 and 45 of the circulation-type banknote storage unit 40.

In a case in which a replenishing operation to a circulation drum of the circulation-type banknote storage unit 30 is to be performed after the replenishing operation to the circulation-type banknote storage unit 40 is finished, for example, the circulation-type banknote storage unit 30 is attached to the attachment section 57, which has become empty by detaching the circulation-type banknote storage unit 40, to perform replenishment from the banknote replenishing box. Banknotes of the corresponding denomination are fed to a circulation drum 31 in the circulation-type banknote storage unit 30 to be replenished. After replenishment of banknotes to the circulation-type banknote storage unit 30 is completed, the banknote replenishing box is detached from the attachment space 56, and the circulation-type banknote storage unit 30 is attached to the attachment space 56 and the circulation-type banknote storage unit 40 having been replenished with banknotes is attached to the attachment space 57.

[Paper Feed Device (Paper Sheet Replenishing Box), Feed Tray, and Others]

<Paper Feed Device (Banknote Replenishing Box)>

A banknote replenishing box (paper feed device) 100 according to the present invention includes a detachable paper feed tray 200 in a replenishing box body 101, and the paper feed tray accommodate a plurality of denominations having different sizes and shapes, in the present example, in a state in which banknotes P1, P2, and P3 of three denominations are placed in a bundle by denomination and layered in three stages. The conventional banknote replenishing box has a configuration in which a banknote bundle of one denomination is set in the replenishing box body 101 to feed banknotes. However, in the present invention, banknotes in a plurality of bundles of different denominations accommodated in the paper feed tray 200 set in the replenishing box body 101 are sequentially fed one by one, and eventually are respectively stored in the circulation-type banknote storage units 30 and 40 that store the corresponding denomination, or in the collection box 50. Since the paper feed tray has a configuration capable of being attached and detached with respect to the existing replenishing box body for one denomination, the replenishing box body does not need to be redesigned.

That is, the banknote replenishing box 100 includes the replenishing box body 101, and the paper feed tray 200 that is detachably attached to the replenishing box body and can accommodate banknotes (bundles) P1, P2, and P3 of different sizes and of two or more denominations layered on each other in a vertical positional relation.

By attaching the paper feed tray 200 to the replenishing box body 101 to feed banknotes, banknotes of a respectively corresponding denomination can be continuously supplied to the plurality of circulation-type banknote storage units or the plurality of circulation units by a continuous replenishing operation from one banknote replenishing box. Further, an operation to set a new banknote bundle with respect to the paper feed tray is quite easy since it is only necessary to open the banknote replenishing box 100 to take out a paper feed cassette and set the banknote bundle by denomination onto respective tray pieces 201, 211, and 221, and the workability is not deteriorated.

Further, the paper feed tray 200 includes a plurality of tray pieces on which banknotes of one denomination are placed. A guide member that regulates the position in a longitudinal direction and the position in a width direction of banknotes having various different lengths and widths is provided in each tray piece. Therefore, banknotes of various denominations can be stored in one paper feed tray and one banknote replenishing box, and can be continuously fed.

Therefore, an operator is freed from a complicated and inefficient operation of performing a replenishing work while preparing and replacing a plurality of banknote replenishing boxes for each denomination.

The banknote replenishing box is described below based on the drawings.

Figure 5:
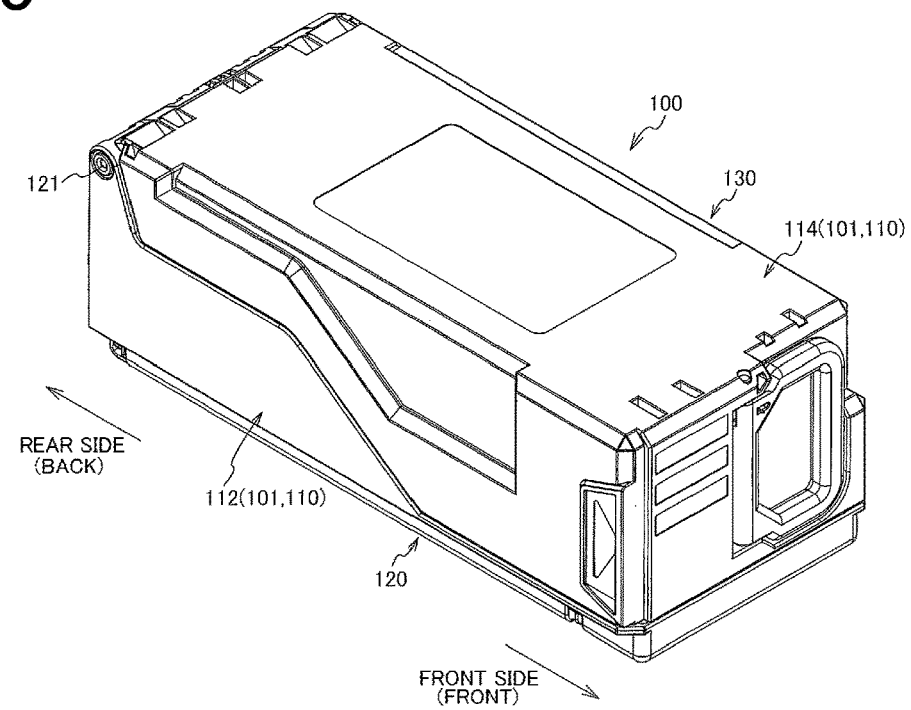
FIG. 5 is an external perspective view of the banknote replenishing box according to the embodiment of the present invention.

FIG. 5 is an external perspective view of the banknote replenishing box 100, and the banknote replenishing box 100 has an external configuration that can be attached to the attachment sections 56 and 57 in which the circulation-type banknote storage units 30 and 40 of the banknote processing device 1 are accommodated, and a configuration (a feed route 123 and an outlet 122) that enables smooth feed of banknotes to the transport route 9*b* of the banknote processing device in the state attached to the attachment section.

Figure 6A:
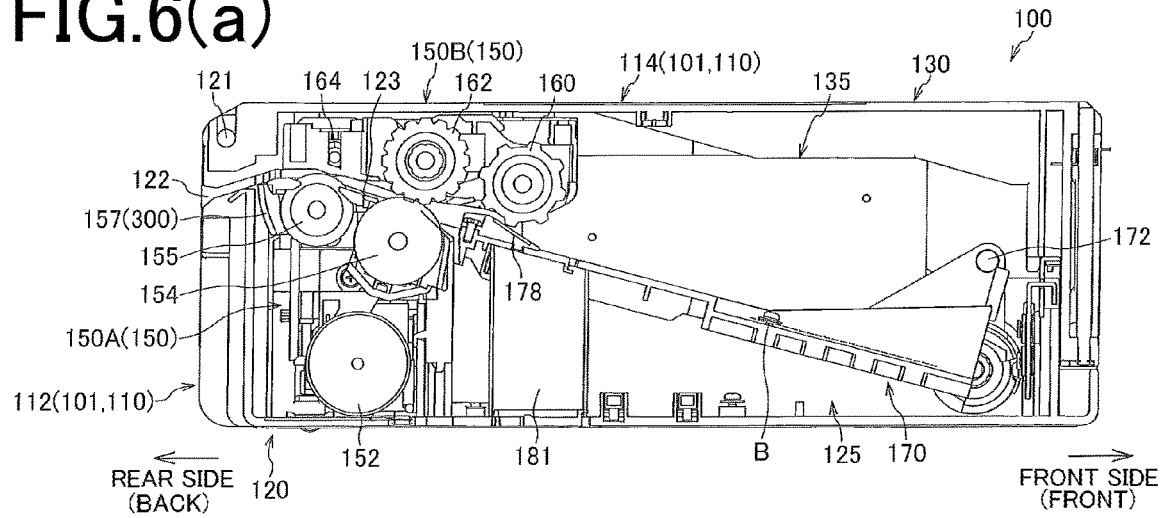
FIG. 6(*a*) is a longitudinal sectional view of the banknote replenishing box in a state in which a paper feed tray is not set, and FIGS. 6(*b*) and (*c*) are longitudinal sectional views of the banknote replenishing box in a state in which the paper feed tray is set.
Figure 6B:
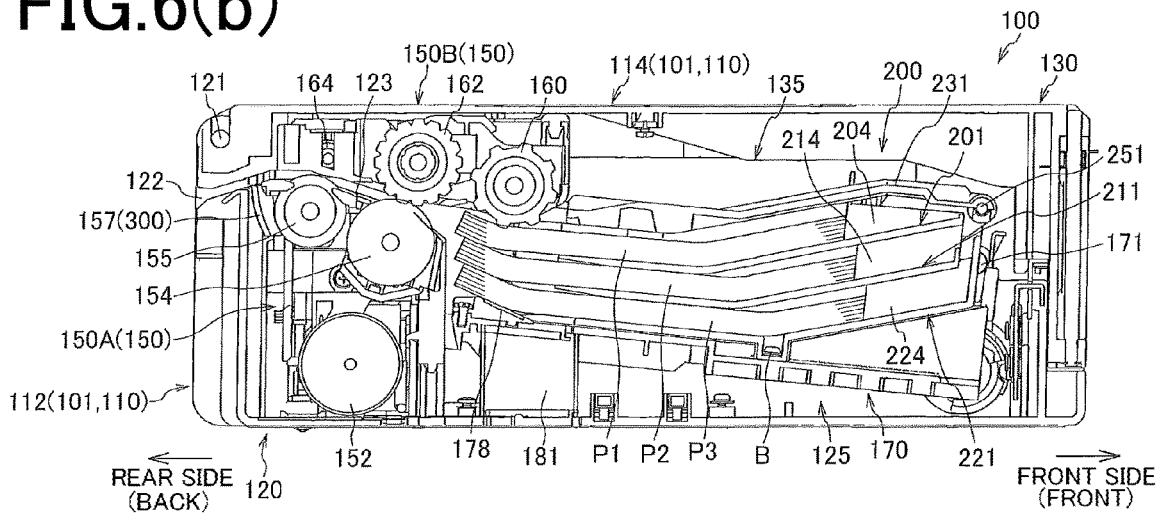
Figure 6C:
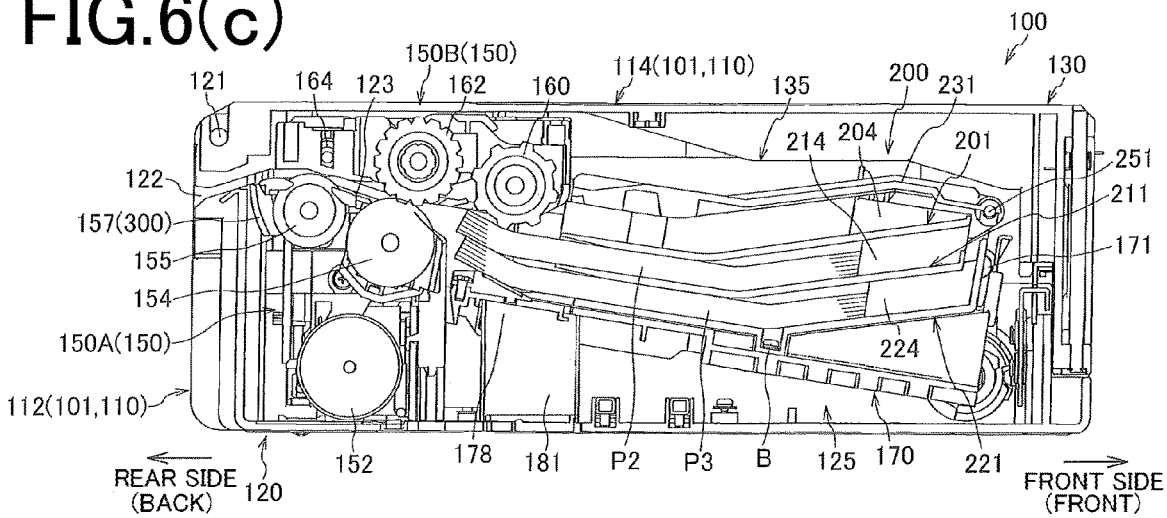
Figure 7:
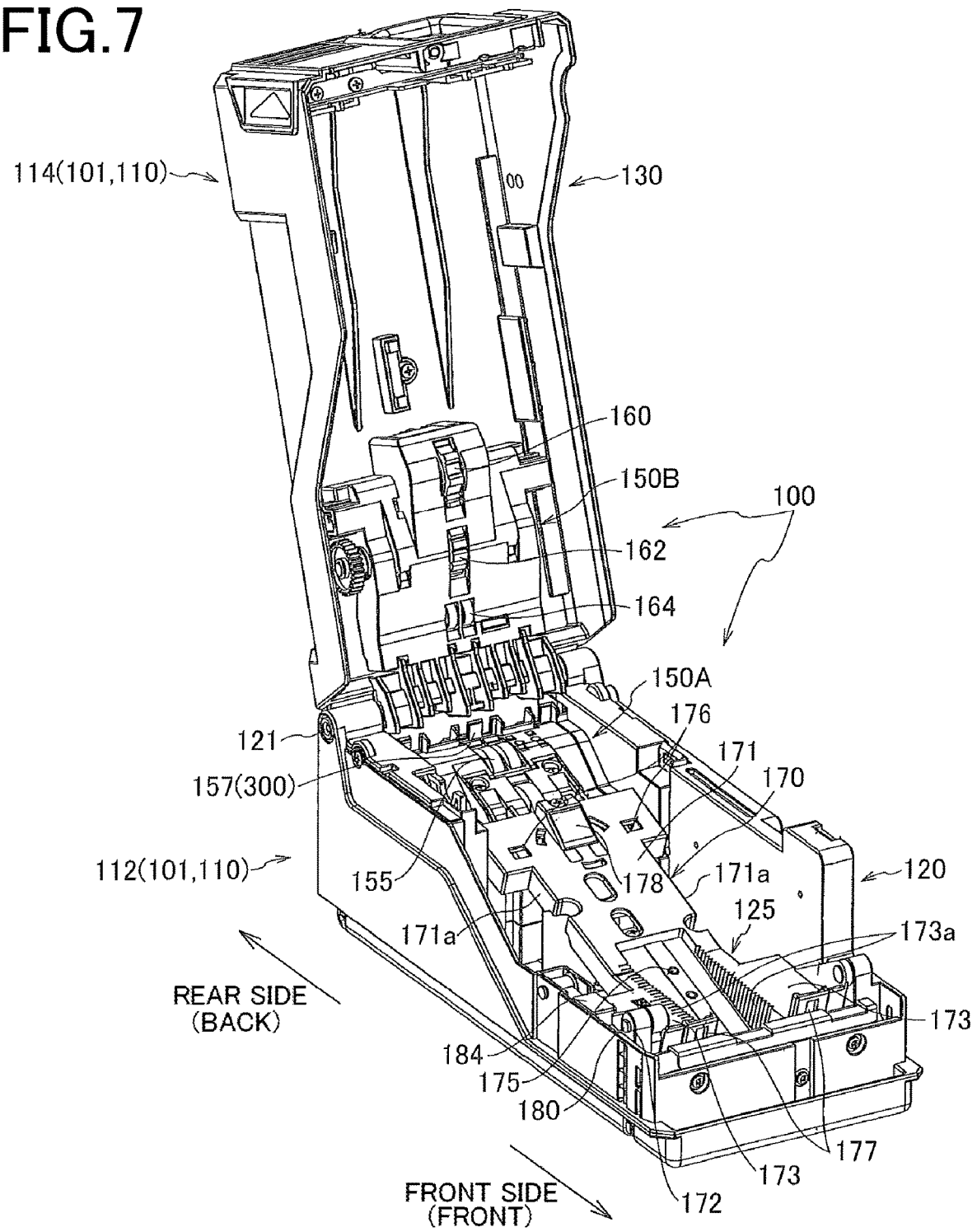
FIG. 7 is a perspective view illustrating a state in which the banknote replenishing box is opened, with the paper feed tray and a guide member for one denomination not being set.
Figure 8B:
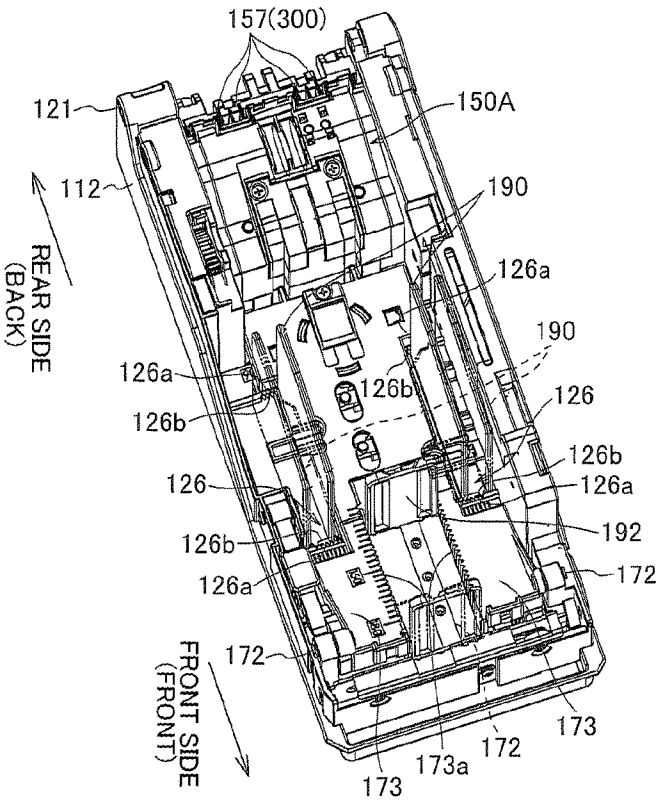
FIG. 8(*a*) is a perspective view illustrating a state in which the banknote replenishing box is opened, with the guide member for one denomination being set, and FIG. 8(*b*) is a perspective view in a planar direction of a lower unit single body in (*a*).
Figure 8A:
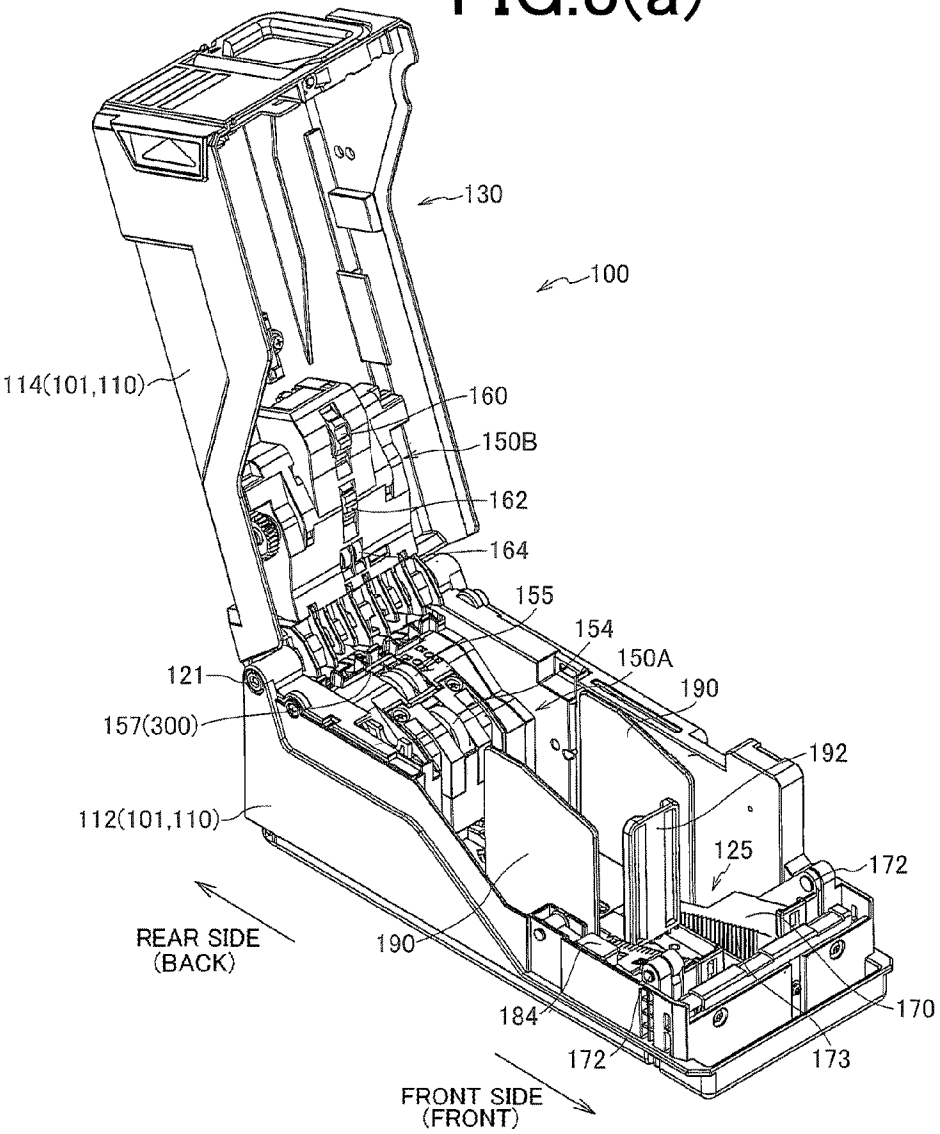
Figure 9:
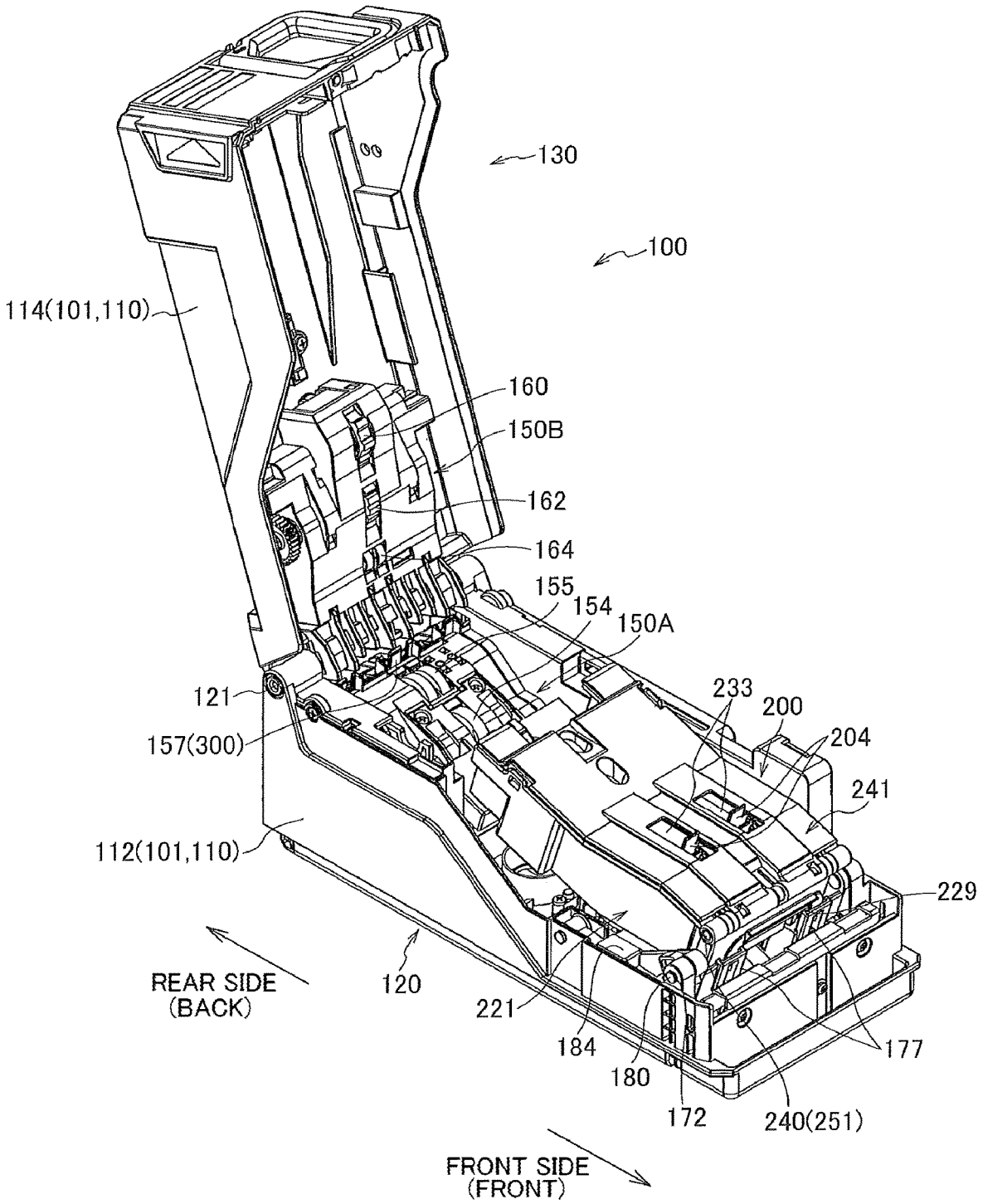
FIG. 9 is a perspective view illustrating a state in which the banknote replenishing box is opened, with the paper feed tray being set.
Figure 10A:
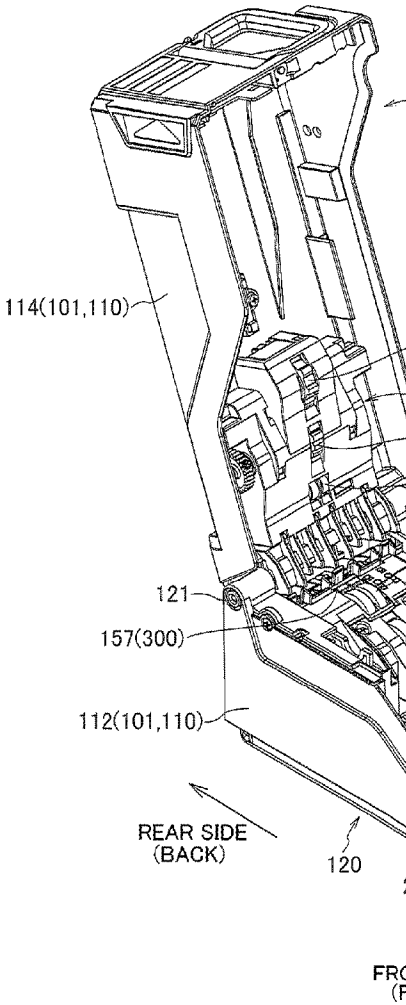
FIGS. 10(*a*) and (*b*) are respectively another perspective view of a state in which the banknote replenishing box is opened, with the paper feed tray being set, and a partially exploded perspective view illustrating a procedure of replacing a stop roller.
Figure 10B:
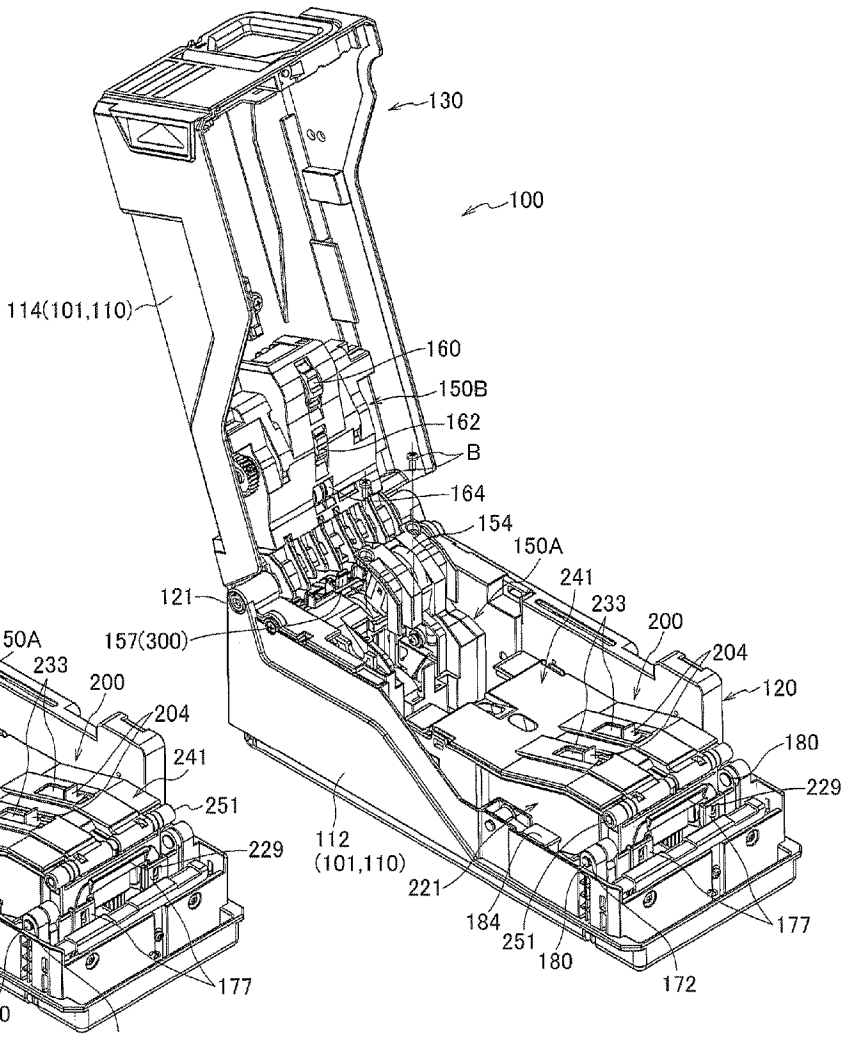
Figure 11B:
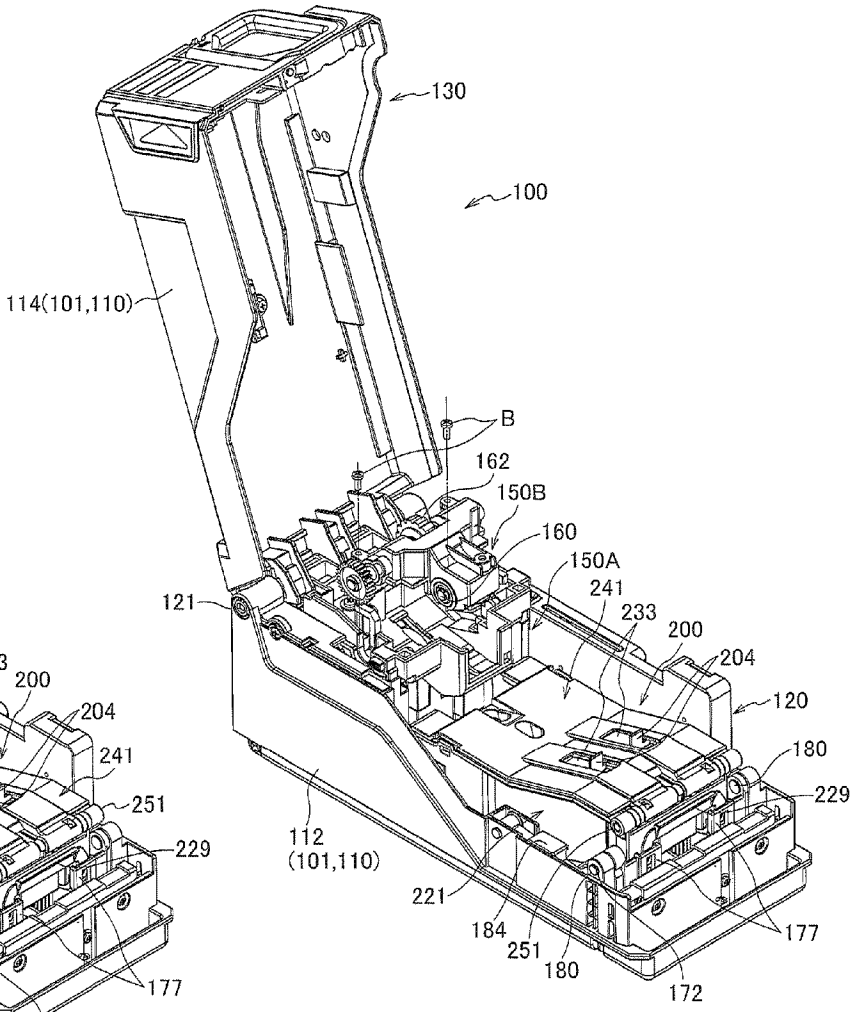
FIGS. 11(*a*) and (*b*) are respectively another perspective view of a state in which the banknote replenishing box is opened, with the paper feed tray being set, and a partially exploded perspective view illustrating a procedure of replacing a pickup roller and a feed roller.
Figure 11A:
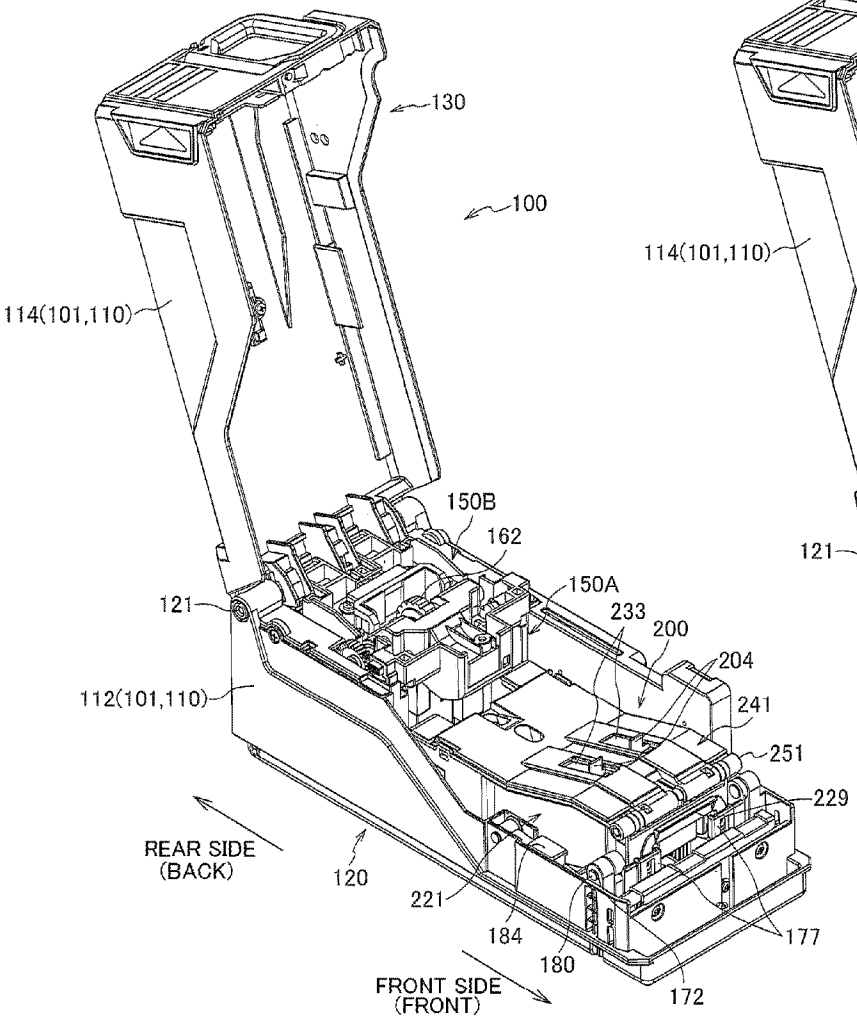
Figure 12A:
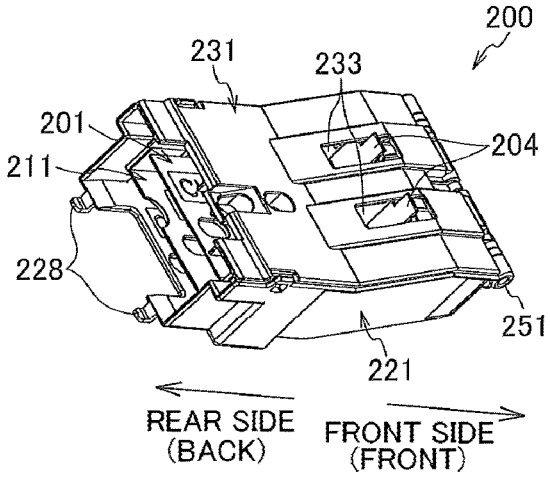
FIGS. 12(*a*), (*b*), (*c*), and (*d*) are respectively a rear-side perspective view illustrating a closed state of the paper feed tray, a rear-side perspective view illustrating a state in which a tray cover of the paper feed tray is opened, a front-side perspective view illustrating a closed state of the paper feed tray, and a perspective view illustrating a state in which another tray piece is opened with respect to a third tray piece.
Figure 12B:
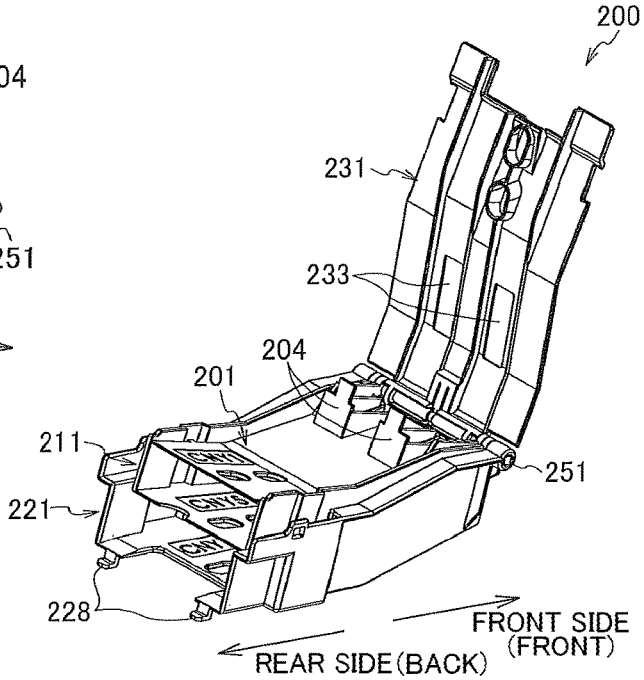
Figure 12C:
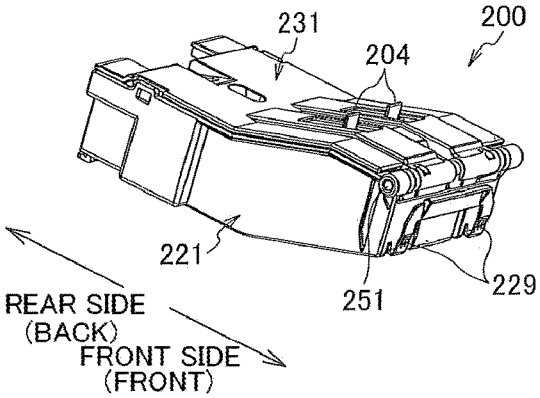
Figure 12D:
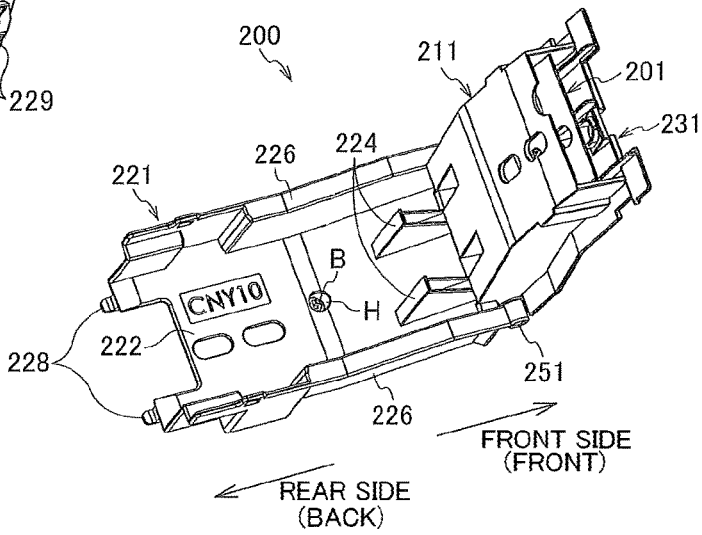

FIG. 6(*a*) is a longitudinal sectional view of the banknote replenishing box in a state in which the paper feed tray is not set, and FIGS. 6(*b*) and (*c*) are longitudinal sectional views of the banknote replenishing box in a state in which the paper feed tray is set. FIG. 7 is a perspective view illustrating a state in which the banknote replenishing box is opened, with the paper feed tray and the guide member for one denomination not being set. FIG. 8(*a*) is a perspective view illustrating a state in which the banknote replenishing box is opened, with the guide member for one denomination being set, and FIG. 8(*b*) is a perspective view in a planar direction of a lower unit single body in (a). FIG. 9 is a perspective view illustrating a state in which the banknote replenishing box is opened, with the paper feed tray being set. FIGS. 10(*a*) and (b) are respectively another perspective view of a state in which the banknote replenishing box is opened with the paper feed tray being set, and a partially exploded perspective view illustrating a procedure of replacing a stop roller. FIGS. 11(*a*) and (*b*) are respectively another perspective view of a state in which the banknote replenishing box is opened with the paper feed tray being set, and a partially exploded perspective view illustrating a procedure of replacing a pickup roller and a feed roller.

The banknote replenishing box 100 can exert a paper feeding function for one denomination by a paper feed mechanism 150, by setting a banknote bundle on a backing plate 170 in a state in which guide members (side guides) 190 in a width direction and a guide member (an end guide) 192 in a longitudinal direction are set in an inner bottom part of the replenishing box body matched with the size and the shape of a banknote of a specific denomination, as illustrated in FIGS. 8, in a state in which the paper feed tray 200 is not set in the replenishing box body 101. Meanwhile, by detaching the respective guide members and setting the paper feed tray 200 on the backing plate 170, the banknotes of respective denominations on the paper feed tray can be fed sequentially by the paper feed mechanism 150.

The banknote replenishing box (paper feed device) 100 is schematically constituted by the replenishing box body 101 and the paper feed tray 200.

The replenishing box body (paper feed device body) 101 schematically includes a lower unit 120 and an upper unit 130 pivotally supported so as to be able to be opened or closed relative to each other by a shaft support 121 provided on a rear side, and the paper feed mechanism 150 (a lower paper feed mechanism 150A and an upper paper feed mechanism 150B) arranged across the respective units 120 and 130.

The lower unit 120 includes a lower casing 112 and the lower paper feed mechanism 150A arranged on the lower casing side, and the upper unit 130 includes an upper casing 114 and the upper paper feed mechanism 150B arranged on the upper casing side.

The lower casing 112 and the upper casing 114 constitute the casing 110.

The lower unit 120 includes the lower paper feed mechanism 150A being a part of the paper feed mechanism 150 on the rear side, and also includes a paper-feed tray setting portion 125, in which the backing plate 170 and the paper feed tray 200 are arranged, on the front side of the lower paper feed mechanism.

The upper unit 130 includes the upper paper feed mechanism 150B being a part of the paper feed mechanism 150 on the rear side, and also includes a paper feed tray accommodating unit 135 to receive an upper part of the paper feed tray on the front side of the upper paper feed mechanism. The upper paper feed mechanism 150B can move rotationally independently with respect to the upper unit 130 (the upper casing 114) by being pivotally supported so as to be able to move rotationally in a vertical direction by the shaft support 121, and can move between a posture locked on the side of the upper casing 114 as illustrated in FIG. 10 and a posture away from the upper casing and coming down onto the lower drive mechanism 150A as illustrated in FIG. 11.

The lower paper feed mechanism 150A and the upper paper feed mechanism 150B are arranged to face each other, with the feed route 123 placed therebetween, which moves a banknote fed from the paper feed tray to the outlet 122 provided in the casing.

The lower paper feed mechanism 150A includes a motor 152 being a drive source of respective rollers, a stop roller 154 arranged below the feed route 123 to come in contact with a lower surface of a banknote to be discharged, a pull roller 155 arranged on a downstream side of the stop roller to come in contact with the lower surface of the banknote to be discharged, and a shutter mechanism 300 including a shutter piece 157 that opens and closes the outlet 122.

The upper paper feed mechanism 150B includes a pickup roller (feed unit) 160 that comes in contact with an upper surface of an uppermost banknote set in the paper feed tray 200 at a front end thereof in a transport direction to rotate in a clockwise direction in FIGS. 6, thereby feeding the banknote to the feed route 123, a feed roller 162 arranged on a downstream side of the pickup roller and rotate in the clockwise direction to separate a banknote in an overlapped feed state with the stop roller 154 and transport only the upper banknote to the downstream side, and a tension roller 164 as a driven roller arranged on a downstream side of the feed roller to pull out and transport a banknote at a nip portion between the pull roller 155 and the tension roller 164.

The pickup roller 160 and the feed roller 162 are driven by a drive force from the motor 152 transmitted via a drive transmission mechanism (not illustrated) and the pull roller 155 is driven by another motor (not illustrated).

The stop roller (brake roller) 154 as a friction separation member is configured not to rotate in a transport direction, but to move rotationally at a predetermined pitch in an opposite direction to the banknote transport direction (banknote return direction), every time a banknote passes therethrough in order to avoid local wear due to contact with the banknote.

As illustrated in FIG. 10(*b*), by removing a screw B in a state in which the upper unit 130 is opened with respect to the lower unit 120, units including the stop roller 154 and a support member thereof can be detached from the lower paper feed mechanism 150A to be replaced or repaired.

Further, as illustrated in FIG. 11(*b*), by removing the screw B in a state in which the upper unit 130 is opened with respect to the lower unit 120 and the upper paper feed mechanism 150B is brought down onto the lower paper feed mechanism 150A, units including the pickup roller 160, the feed roller 162, and support members thereof can be detached from the upper paper feed mechanism 150B to be replaced or repaired.

As illustrated in FIGS. 6, FIG. 7, FIG. 8, and the like, the paper feed tray 200 or the backing plate 170 for directly loading banknotes is arranged on an upper surface of a bottom surface of the paper-feed tray setting portion 125 of the lower unit 120, and the backing plate 170 is pivotally supported so as to be able to move rotationally in a vertical direction about a rotation shaft 180 inserted into a shaft hole 172 at a front end thereof and is biased upward by a resilient member 181. Therefore, the backing plate 170 can change the posture between an ascending position illustrated in FIG. 6(*a*) and descending positions illustrated in FIGS. 6(*b*) and (*c*). In the state illustrated in FIGS. 6(*b*) and (*c*) with the paper feed tray 200 being loaded, the backing plate 170 is in a descending state in which the resilient member 181 is compressed.

As illustrated in FIG. 7, the backing plate 170 schematically includes a bottom plate 171 for supporting a third tray piece 221 of the paper feed tray on an upper surface thereof, the shaft hole 172 provided at a front end of the bottom plate, front guide holding units 173 in a substantially triangular shape each provided in a protruding manner on opposite sides in a width direction closer to the front side of the bottom plate and a screw hole (a female thread hole) 175 for screwing the third tray piece 221 located at the lowest part of the paper feed tray. The backing plate 170 further includes a pair of slots 176 being a small hole formed so as to penetrate at the rear position of the bottom plate, two latch receivers (resilient pieces) 177 provided at a front end of the bottom plate, and a pad 178 that comes in contact with the lower surface of a banknote bundle to regulate sliding at the time of feeding by the pickup roller 160.

As illustrated in FIG. 7 and FIGS. 8, a banknote bundle (for example, up to 400 sheets) is directly set on the backing plate 170 in a state in which the paper feed tray 200 is not set on the backing plate, when banknotes of only one denomination are to be fed.

In FIG. 7 and FIGS. 8, a reference numeral 184 denotes a backing plate stopper, and in a state in which the backing plate 170 is brought down against the resilient member 181, the backing plate can be locked in a descending state with respect to a side wall of the lower casing 112 by pressing down the backing plate stopper 184, or the locking can be released by pulling out the backing plate stopper upward. The backing plate stopper 184 is a member attached from above into a space between the side walls of the lower casing and backing plate side portions, and constitutes a ratchet locking mechanism (not illustrated) between the side walls of the lower casing and the backing plate side portions. By pulling up the backing plate stopper to be detached from the lower casing, the backing plate becomes a free state and can be moved rotationally in a vertical direction about the rotation shaft 180 by the resilient member 181.

When banknotes of only one denomination are to be fed, in a state in which a banknote bundle of one denomination is directly set on an upper surface of the bottom plate 171 of the backing plate, the uppermost banknote is extracted and separated by the paper feed mechanism 150 and fed to outside of the banknote replenishing box from the outlet 122 through the feed route 123.

As illustrated in FIGS. 8, drop-in guide holding units 126 to set plate-like side guides 190 for positioning both side faces in a width direction of the banknote bundle set on the backing plate 170 each in an upright state are provided on a bottom surface of the paper-feed tray setting portion 125 corresponding to the opposite sides of the backing plate in the width direction.

As illustrated in FIG. 8(*b*), the right and left guide holding units 126 that respectively position and hold the side guide 190 are formed at portions on the bottom surface of the paper-feed tray setting portion 125 corresponding to a notch 171*a* respectively provided at opposite ends in a width direction of the bottom plate 171 of the backing plate. The guide holding units 126 respectively include multiple grooves (positioning recesses) 126*b* respectively formed in two walls 126*a* arranged opposite to each other in a predetermined longitudinal positional relation. The groove (positioning recess) 126 is provided in plural in the two walls 126*a* at a predetermined pitch in the width direction, for inserting a bottom edge of the plate-like side guide 190 for positioning the side guide 190 in an upright state. The individual grooves 126*b* formed in the opposite walls facing each other have an opposite positional relation in which the grooves are matched with each other on a one-to-one basis. Therefore, the side guides 190 can be set while maintaining the parallel posture thereof, by inserting bottom edges of the side guides 190 into arbitrary grooves that form a pair in a posture parallel to a feed direction. Further, by finely setting the pitch between the adjacent grooves 126*b* in a unit of millimeter, the set position in a width direction of the side guide in the guide holding unit 126 can be finely adjusted corresponding to a change of the width dimension of the banknote set on the backing plate.

The front guide holding units 173 in a substantially triangular shape each provided in a protruding manner on opposite sides in a width direction closer to the front side of the bottom plate 171 of the backing plate are means for holding the position of the banknote bundle of one denomination in an upright state by inserting a bottom edge of the end guide 192 that regulates the position of a rear end in a transport direction of the banknote bundle into the front guide holding units 173, in the state illustrated in FIG. 8. On opposite surfaces of the respective front guide holding units 173, there are multiple grooves (positioning recesses) 173*a* extending in a vertical direction at a predetermined pitch in a longitudinal direction for positioning and holding the end guide in an upright state by inserting the bottom edge of the end guide therein. The individual grooves 173*a* formed in the opposite surfaces of the respective front guide holding units 173 have an opposite positional relation in which the grooves are matched with each other on a one-to-one basis. Therefore, the end guide 192 can be set while maintaining the posture orthogonal to a feed direction, by inserting a bottom edge of the end guide 192 into arbitrary grooves that form a pair in the posture orthogonal to the feed direction. Further, by finely setting the pitch between the adjacent grooves 173*a* in a unit of millimeter, the set position in a longitudinal direction of the end guide between the front guide holding units 173 can be finely adjusted corresponding to a change of the longitudinal dimension of the banknote set on the backing plate.

The side guides 190 and the end guide 192 can be set at arbitrary positions between a position corresponding to the smallest banknote size indicated by a solid line in FIGS. 8(*a*) and (*b*) and a position corresponding to the largest banknote size indicated by a broken line in FIG. 8(*b*), by using the respective grooves 126*b* and 173*a*.

In the configuration of the banknote replenishing box in FIG. 8 in which banknotes of only one denomination are set and fed, for example, in a case in which banknotes of three denominations are to be replenished in the respective circulation-type banknote storage units, not only it is necessary to prepare three replenishing boxes accommodating banknotes of each denomination, but also after replenishment of banknotes of one denomination by one banknote replenishing box is completed, the banknote replenishing box is replaced in the attachment section of the banknote handling device, and a replenishing operation of banknotes of the next denomination needs to be performed, thereby prolonging the operation time.

<Paper Feed Tray>

Figure 13:
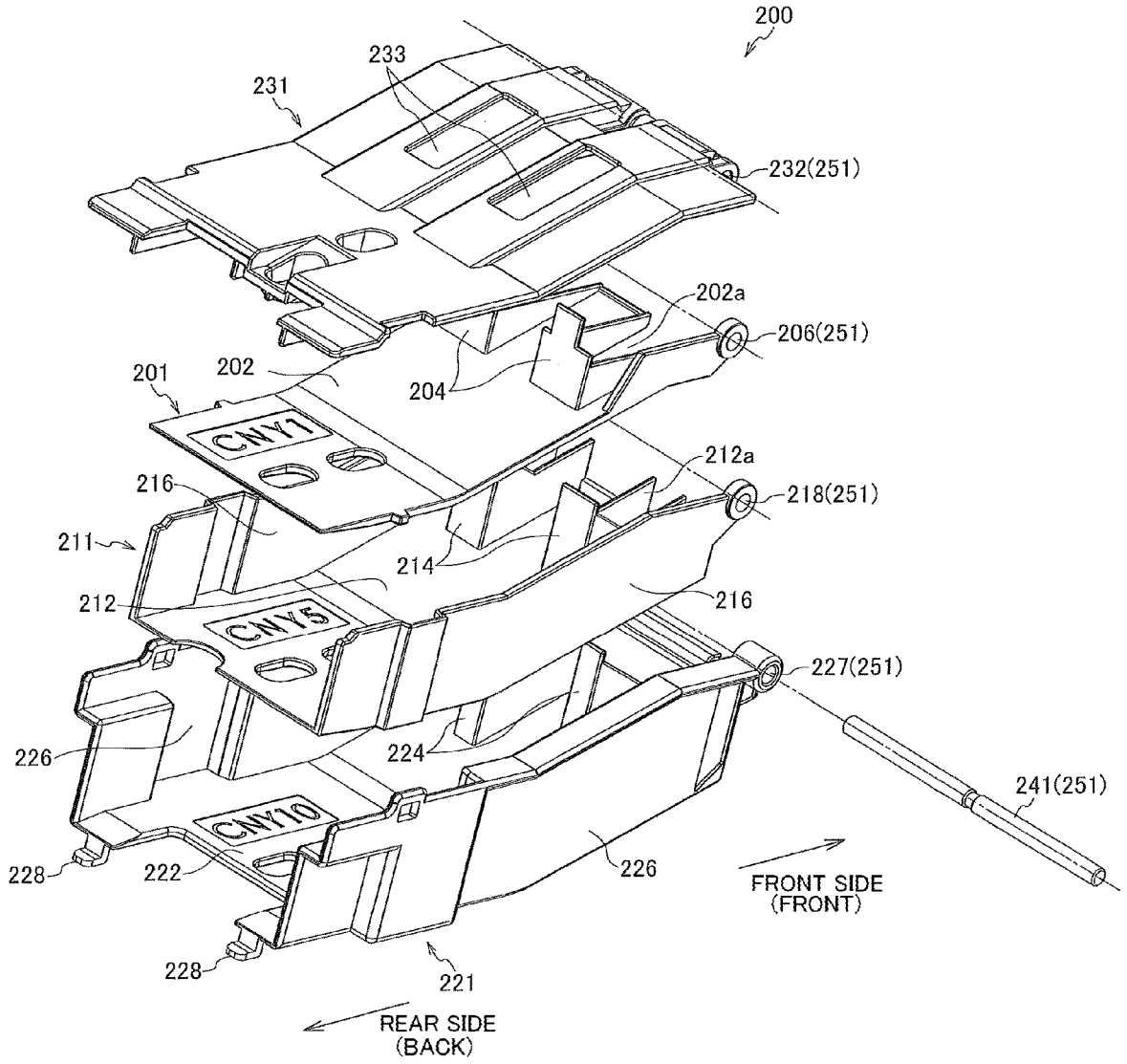
FIG. 13 is an exploded perspective view of a paper feed tray according to one example.
Figure 14A:
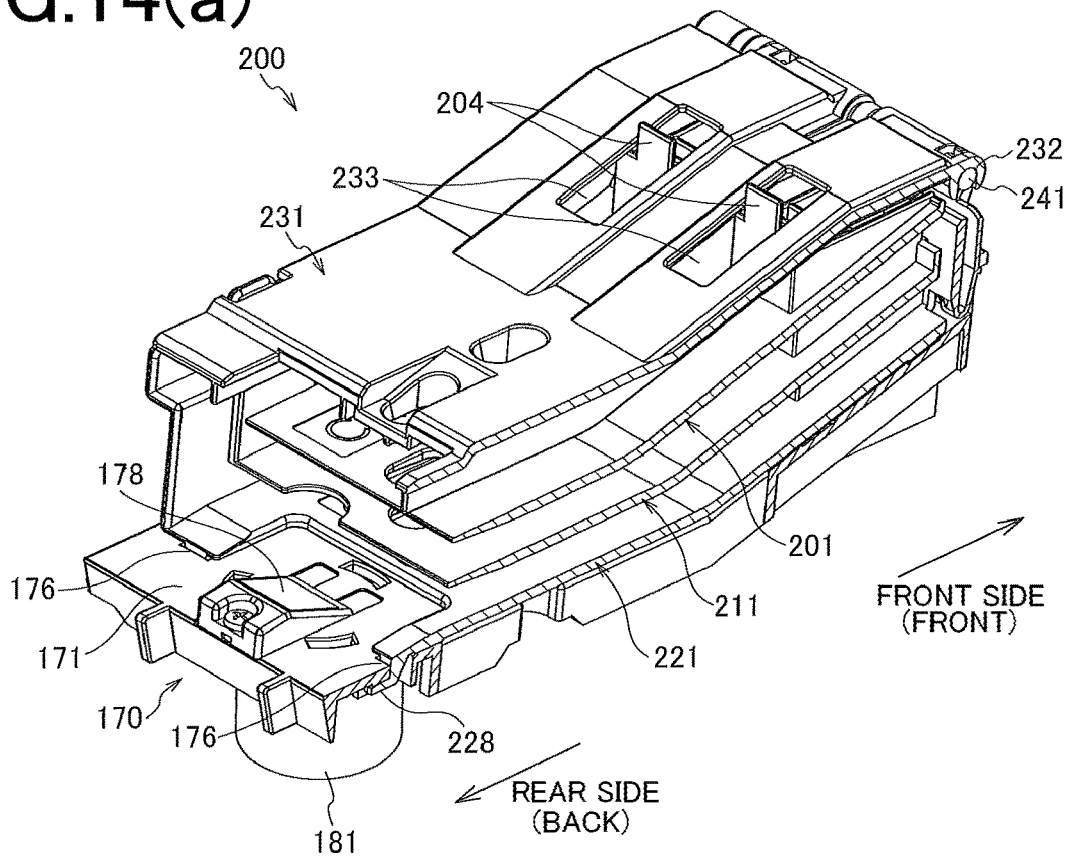
FIGS. 14(*a*) and (*b*) are respectively a rear-side perspective view of a partial section illustrating a state in which the paper feed tray in a closed state is assembled to a backing plate, and a front-side perspective view of the partial section.
Figure 14B:
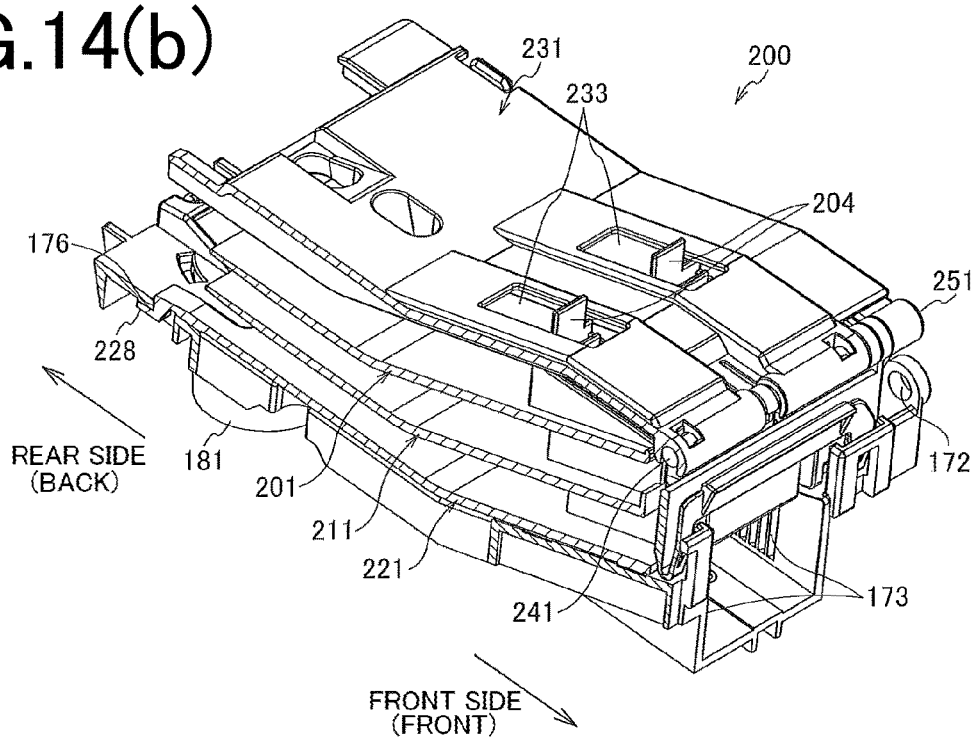
Figure 15B:
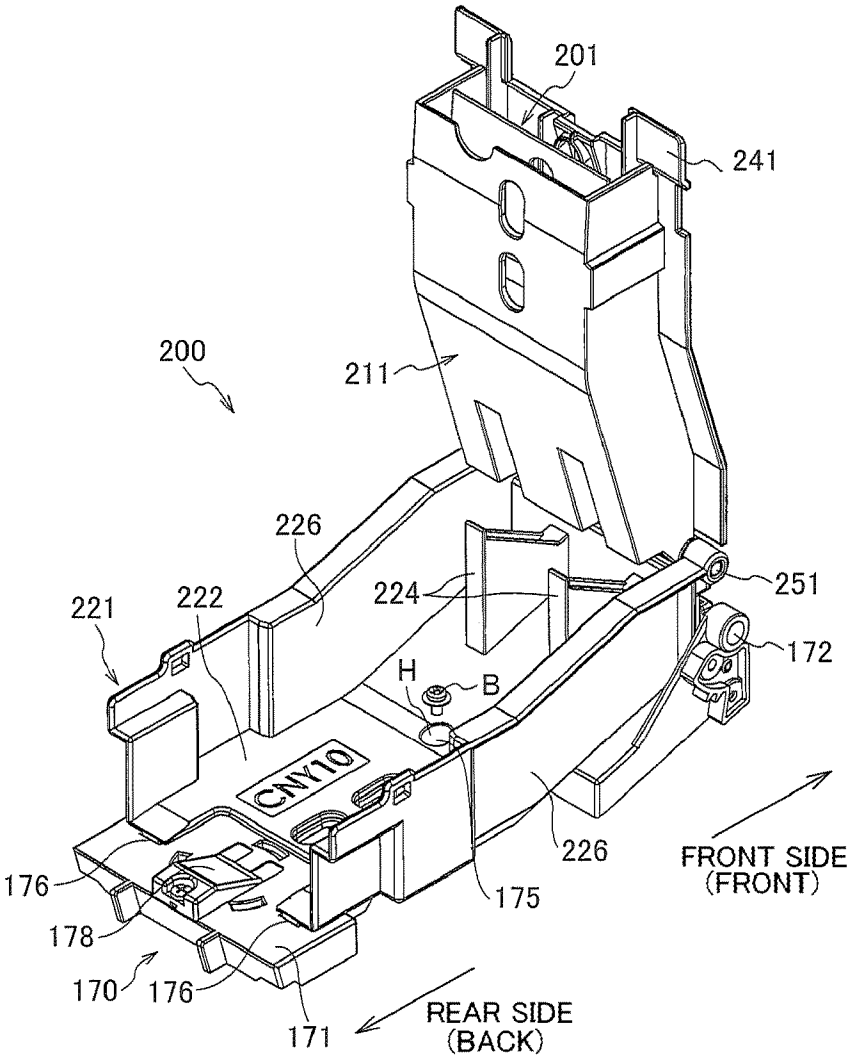
FIGS. 15(*a*) and (*b*) are explanatory diagrams of a procedure of assembling the paper feed tray to the backing plate.
Figure 15A:
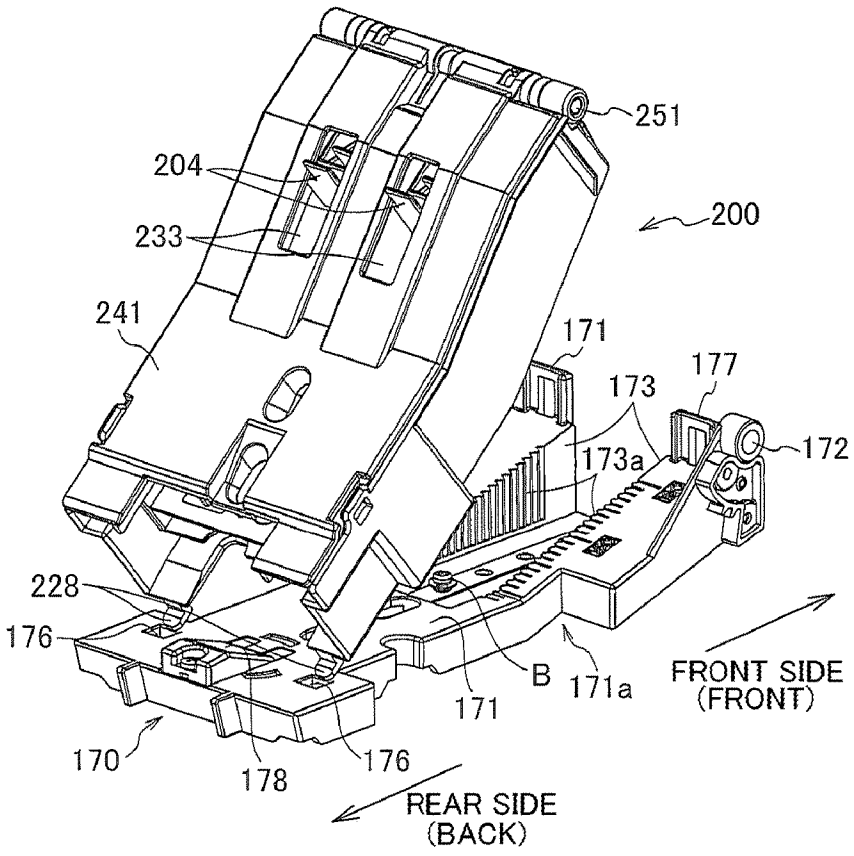
Figure 16:
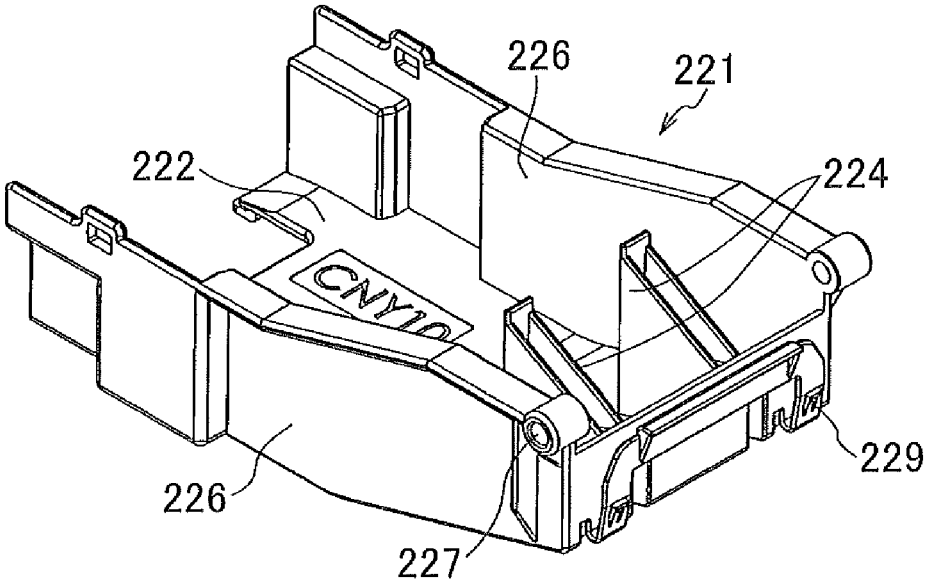
FIG. 16 is a perspective view illustrating a configuration of a single body of the third tray piece.

Next, FIGS. 12(*a*), (*b*), (*c*), and (*d*) are respectively a rear-side perspective view illustrating a closed state of the paper feed tray, a rear-side perspective view illustrating a state in which a tray cover of the paper feed tray is opened, a front-side perspective view illustrating a closed state of the paper feed tray, and a perspective view illustrating a state in which another tray is opened with respect to the third tray piece. FIG. 13 is an exploded perspective view of the paper feed tray. FIGS. 14(*a*) and (*b*) are respectively a rear-side perspective view of a partial section illustrating a state in which the paper feed tray in a closed state is assembled to the backing plate, and a front-side perspective view of the partial section. FIGS. 15(*a*) and (*b*) are explanatory diagrams of a procedure of assembling the paper feed tray to the backing plate. FIG. 16 is a perspective view illustrating a configuration of a single body of the third tray piece.

The paper feed tray 200 is means for storing and stacking a plurality of banknote bundles having different sizes and shapes in different sections, and is attached to a paper feed device such as the banknote replenishing box including the pickup roller (feed unit) 160 that feeds banknotes one by one by coming in contact with an upper surface of banknotes and rotating.

The paper feed tray 200 includes a first tray piece 201 in which a plurality of pieces of first banknotes (first banknote bundle) P1 are placed in a stacked state, a second tray piece 211 arranged immediately below the first tray piece 201 in parallel thereto, in which a plurality of pieces of second banknotes (second banknote bundle) P2 having a larger longitudinal dimension (dimension in a transport direction) than that of the first banknote are placed in a stacked state, and a third tray piece 221 arranged immediately below the second tray piece 211 in parallel thereto, in which a plurality of pieces of third banknotes (third banknote bundle) P3 having a larger longitudinal dimension than that of the second banknote are placed in a stacked state. The paper feed tray 200 also includes rear-end regulating members 204, 214, and 224 that are respectively arranged in the first tray piece 201, the second tray piece 211, and the third tray piece 221 to regulate the rear end position in a transport direction of the first banknote bundle P1, the second banknote bundle P2, and the third banknote bundle P3, thereby aligning the front end positions in the transport direction of the respective banknote bundles to uniform (predetermined) positions, and width-direction regulating members (side plates) 216 and 226 that regulate the positions in a width direction of the first banknote bundle, the second banknote bundle, and the third banknote bundle. Further, the paper feed tray 200 includes a tray cover 231, and a shaft support 251 that makes the respective tray pieces openable in a banknote stacking direction (vertical direction) by pivotally supporting respective front side ends of the first tray piece, the second tray piece, the third tray piece, and the tray cover. After all the first banknotes on the first tray piece have been fed by the paper feed mechanism 150, the uppermost surface of the second banknotes on the second tray piece becomes a contact state with the feed unit by lifting of the backing plate 170. After all the second banknotes on the second tray piece have been fed by the paper feed mechanism, the uppermost surface of the third banknotes on the third tray piece becomes a contact state with the feed unit by lifting of the backing plate 170.

The shaft support 251 makes the respective tray pieces openable by inserting a pivot shaft 241 into respective shaft holes 206, 218, 227, and 232 provided in each front end of the first tray piece 201, the second tray piece 211, the third tray piece 221, and the tray cover 231 and pivotally supporting these tray pieces and the tray cover.

For example, 40 sheets of banknotes can be set in each tray piece.

The first tray piece 201 includes a bottom plate 202 having a size and a shape matched with the first banknotes P1 having the smallest size, the rear-end regulating member 204 of banknotes arranged in an upright state on a rear upper surface of the bottom plate in a transport direction, and the shaft hole 206 provided at a front end (front side end) of the bottom plate.

The second tray piece 211 includes a bottom plate 212 having a size and a shape matched with the second banknotes P2, the rear-end regulating member 214 of banknotes arranged in an upright state on the rear upper surface of the bottom plate in a transport direction, the side plates 216 as width-direction regulating members that are arranged in an upright state from the opposite side edges in a width direction of the bottom plate, and the shaft hole 218 provided at a front end of the bottom plate. In the present example, the side plates 216 commonly regulate not only the second banknotes P2 on the second tray piece but also the position in a width direction of the first banknotes P1 on the first tray piece.

The third tray piece 221 includes a bottom plate 222 having a size and a shape matched with the third banknotes P3, the rear-end regulating member 224 of banknotes arranged in an upright state on the rear upper surface of the bottom plate in a transport direction, the side plates 226 as width-direction regulating members that are arranged in an upright state from the opposite side edges in a width direction of the bottom plate, the shaft hole 227 provided at a front end of the bottom plate, L-shaped engagement pieces 228 for engagement with the backing plate provided in a downward protruding manner at a rear edge of the bottom plate, and a pair of latches 229 provided at a front edge of the bottom plate. The engagement pieces 228 are respectively inserted into the slots 176 provided in the bottom plate of the backing plate, and each latch 229 engages with portions to be engaged provided in the latch receivers 177 provided in the bottom plate of the backing plate.

The tray cover 231 includes the shaft hole 232 at the front end thereof.

As illustrated in FIG. 13, the rear-end regulating members 204 provided in the first tray piece 201 are constituted so that upper parts thereof project upward from openings 233 provided in the tray cover 231.

Further, the rear-end regulating members 214 provided in the second tray piece 211 are constituted so that upper parts thereof project upward from recesses 202*a* provided at positions corresponding to a front part of the first tray piece 201.

Further, the rear-end regulating members 224 provided in the third tray piece 221 are constituted so that upper parts thereof project upward from recesses 212*a* provided at positions corresponding to a front part of the second tray piece 211.

In the present example, a banknote processing device that uses banknotes of 1 Yuan, 5 Yuan, and 10 Yuan that are banknotes of People's Republic of China is described as one example. While a 1 Yuan banknote and a 5 Yuan banknote have the same width dimension (63 millimeters), the width dimension of a 10 Yuan banknote is 70 millimeters. Further, the longitudinal dimensions of the respective banknotes are in the order of "1 Yuan banknote<5 Yuan banknote<10 Yuan banknote".

The paper feed tray 200 is assembled in the lower casing 112 by fixing the third tray piece 221 with respect to the backing plate 170.

As a procedure of attaching the paper feed tray 200 to the backing plate 170, first, as illustrated in FIG. 15(*a*), after inserting the L-shaped engagement pieces 228 provided at the rear edge of the bottom plate 222 of the third tray piece 221 into the slots 176 provided in a rear part of the backing plate 170, the entire paper feed tray is moved rotationally downward by using the engagement pieces as pivot points, and the bottom surface of the bottom plate 222 is pressed and attached to the upper surface of the bottom plate 171 of the backing plate, as illustrated in FIG. 15(*b*). At this time, the latch 229 engages by snap-fit with a portion to be engaged of the latch receiver 177 formed of a spring body provided in the bottom plate of the backing plate. Next, in a state in which the tray cover, the first tray piece, and the second tray piece are opened, a screw B is screwed with the screw hole (female thread hole) 175 provided in the bottom plate 171 of the backing plate to fix the third tray to the bottom plate 171, thereby completing fixation of the paper feed tray. A hole H for inserting a tool such as a driver is formed at a position corresponding to the screw hole 175 is formed in the third tray piece 221.

Attachment of the paper feed tray is sufficient even in a state in which after locking the rear end of the paper feed tray with the slot 176 of the backing plate by the engagement pieces 228, the latches 229 are locked with the latch receivers 177, and fixation by using the screw B can be omitted. In this case, the paper feed tray can be detached from the backing plate by one-touch operation, by operating the latch receivers 177 manually to be widely pushed to detach the latch receivers from the latches 229.

In the paper feed tray 200 set on the backing plate, as illustrated in FIG. 6(*b*), the rear edges in a transport direction of the respective banknote bundles P1, P2, and P3 on the respective tray pieces are respectively regulated by the respective rear-end regulating members 204, 214, and 224, thereby keeping the positions of front edges in the transport direction of the respective banknote bundles at constant positions. The positions of the front edges of the respective banknote bundles at this time overhang from the front edges in the transport direction of the respective tray pieces, and are at positions suitable for paper feed by the pickup roller 160 located immediately above thereof. Further, the front edges of the respective banknote bundles are overlapped on each other in a state of overhanging from the front edge in the transport direction of each tray piece. The bottom surface of the banknote bundle at the lowermost part comes in contact with the friction pad 178 to prevent misregistration, thereby increasing the paper feed stability by the pickup roller.

As the banknotes on the tray piece gradually decrease by a paper feed operation of the pickup roller 160, the entire paper feed tray is lifted substantially vertically by as much as the decreased amount of the banknotes by a lifting force of the resilient member 181, and the uppermost banknote can come in contact with the pickup roller at all times, while maintaining an appropriate feed pressure.

When the paper feed tray is to be detached from the backing plate 170, a procedure opposite to the above is performed. That is, in a state in which the tray cover, the first tray piece, and the second tray piece are opened, the screw B is detached from the screw hole (female thread hole) 175 provided in the bottom plate 171 of the backing plate, and while the latch receivers (snap-fit operation units) 177 are pressed in a releasing direction, the paper feed tray is raised and separated from the backing plate, and the engagement pieces 228 are detached from the slots 176.

In FIG. 6(*b*), since respective banknote bundles are set on the respective tray pieces of the paper feed tray, the pickup roller 160 comes in contact with the upper surface of the first banknotes P1 on the first tray piece to become a state capable of feeding the first banknotes. Meanwhile, in FIG. 6(*c*), since feed of the first banknotes P1 on the first tray piece is complete, the backing plate 170 and the paper feed tray 200 are lifted by the lifting force of the resilient member 181, so that the pickup roller 160 comes in contact with the upper surface of the second banknotes P2 on the second tray piece, to become a state capable of feeding the second banknotes. Although not illustrated, when feed of the second banknotes is complete, the backing plate 170 and the paper feed tray 200 are lifted and the pickup roller 160 comes in contact with the upper surface of the third banknotes P3 on the third tray piece, to become a state capable of feeding the third banknotes.

In the paper feed tray according to the present invention, not only three types of denominations but also two types of denominations can be handled. That is, by setting banknotes of one denomination in the first tray piece, and setting banknotes of another denomination in the second tray piece, the paper feed tray can handle two types of denominations.

The paper feed tray according to the embodiment described above includes three dedicated tray pieces that respectively accommodate three types of denominations. However, in the case of handling only two types of denominations, a configuration of including two tray pieces can be adopted, and in a case of handling four types of denominations, a configuration of including four tray pieces can be adopted.

Further, each tray piece is openable by the shaft support 251 provided at one end thereof. However, it is not always necessary to pivotally support each tray so as to be openable, so long as each tray can be assembled in a stacked state with high consistency.

Further, the banknotes set in the tray piece located on the upper side have a smaller size than that of the banknotes set in the lower tray piece. However, the banknotes set in the tray piece located on the upper side may have a larger size than that of the banknotes set in the lower tray piece.

<Shutter Mechanism>

Figure 17A:
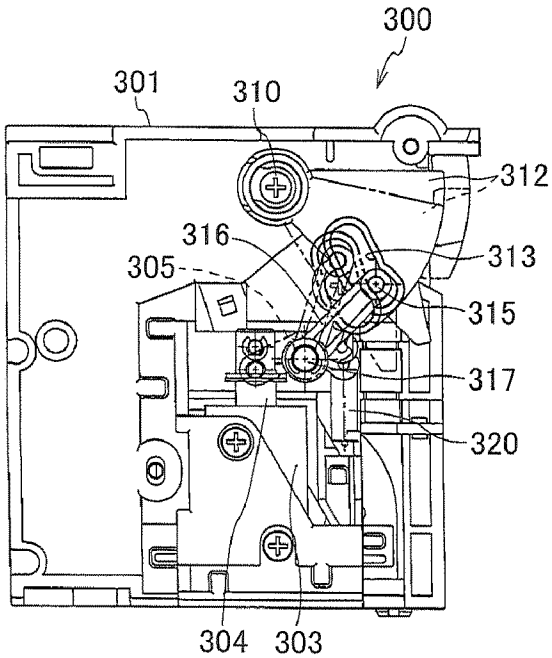
FIG. 17 are explanatory diagrams of a configuration and operations of a shutter mechanism, while FIG. 17(*a*) is a schematic explanatory diagram of an operation principle, (*b*) is an external perspective view illustrating a shutter operating state, and (*c*) is an external perspective view illustrating a shutter retreating state.
Figure 17B:
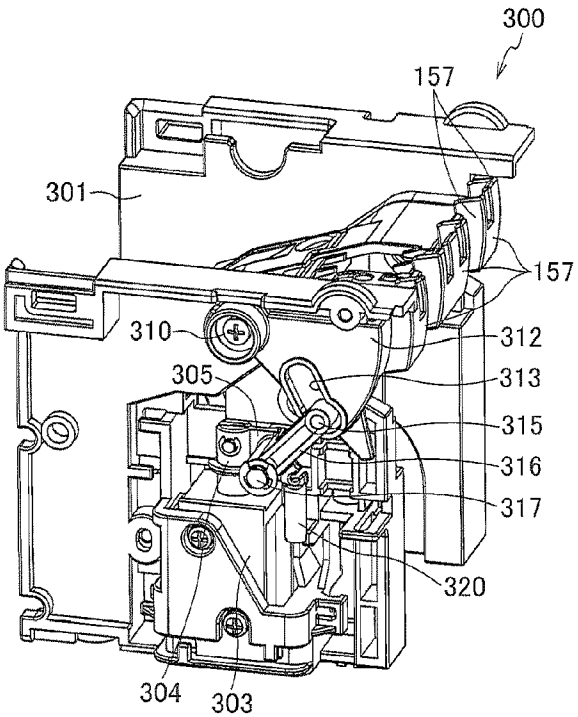
Figure 17C:
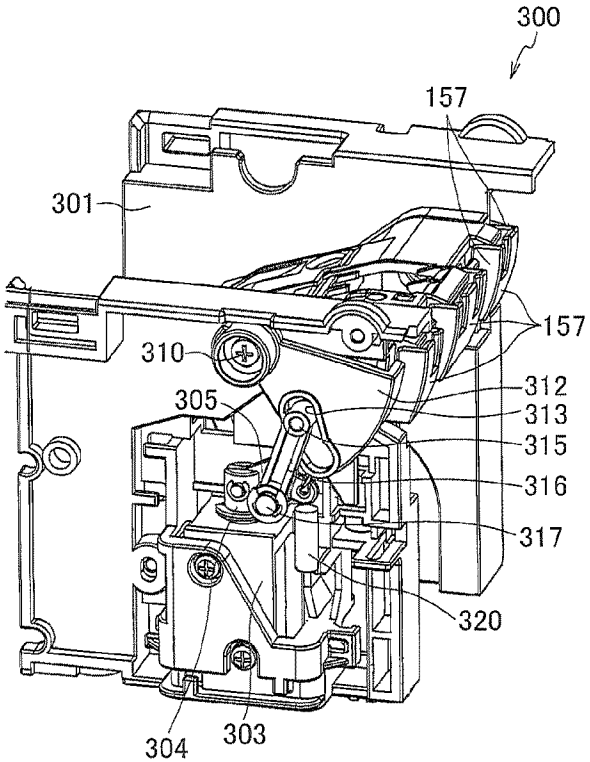

FIG. 17 are explanatory diagrams of a configuration and operations of the shutter mechanism 300. FIG. 17(*a*) is a schematic explanatory diagram of an operation principle, (*b*) is an external perspective view illustrating a shutter operating state, and (*c*) is an external perspective view illustrating a shutter retreating state.

The shutter mechanism 300 schematically includes a solenoid 303 supported by a frame 301, and the shutter piece 157 pivotally supported so as to move rotationally by a shaft portion 310 provided in the frame and driven by the solenoid.

The shutter piece 157 closes the outlet 122 by being held in a projecting state as in FIG. 17(*b*) during a period in which the banknote replenishing box is not operating (at the time of non-excitation of the solenoid), thereby enabling to prevent an illegal act such as inserting an illegal tool from the outlet to pull out the banknote. Further, when the banknote replenishing box is operating (at the time of excitation of the solenoid), by setting the shutter piece in a retreated state as in FIG. 17(*c*) to open the outlet 122, the banknote fed from the banknote replenishing box can be discharged to outside.

The shutter piece 157 is formed of a plurality of claws provided in a base 312 having a fan-like side shape, and moves rotationally in a vertical direction about the shaft portion 310. A long hole 313 is provided in the base 312 by bending a part of an inner wall thereof, and a pin 315 is loosely fitted into the long hole so as to be able to move therein. One end of a shutter link 316 is coupled with the pin 315 so as to be able to move rotationally. The other end of the shutter link 316 is fixed to a pivot shaft 317 pivotally supported by the frame 301 so as not to be able to move but to be able to rotate. Therefore, the pin 315 swings about the pivot shaft 317 within a radius being the length of the shutter link. A tension spring 320 with one end being fixed to the shutter link 316 and the other end being fixed to the frame functions so as to move the pin 315 to a lowered position illustrated in FIG. 17(*b*) via the shutter link when the solenoid is not operating, thereby projecting the shutter piece 157 to close the outlet 122.

One end of a coupling piece 305 is pivotally supported by a plunger 304 of the solenoid 303 so as to be able to move rotationally in a vertical direction, and the other end of the coupling piece 305 is integrated with the pivot shaft 317. Therefore, when the solenoid is not operating as illustrated in FIG. 17(*b*), the plunger 304 projects, and the tension spring 320 moves the pivot shaft 317 and the shutter link 316 rotationally in a clockwise direction, thereby moving the pin 315 in the long hole 313 in a descending direction. In a descending process, the pin presses a right inner wall of the long hole to a right direction to move the base 312 rotationally in a counter-clockwise direction. Therefore, the shutter piece 157 integrated with the base 312 projects upward as illustrated in FIG. 17(*b*), to become a state of blocking the outlet 122.

When the banknote replenishing box is not attached to the banknote processing device, power is not supplied to the solenoid. Therefore, by constituting the banknote processing device in such a manner that the shutter piece blocks the outlet when the solenoid is in an off state, an occurrence of an illegal act can be prevented at a stage in which the banknote replenishing box alone is transported and stored.

Meanwhile, when the banknote replenishing box is attached to the attachment section of the banknote processing device and is connected to a power supply by a connector (not illustrated), the banknote replenishing box becomes an operating state illustrated in FIG. 17(*c*). That is, in a non-operating state in FIG. 17(*b*), when the solenoid is turned on, the plunger 304 recedes as illustrated in FIG. 17(*c*). Therefore, the pivot shaft 317 integrated with the coupling piece 305 and the shutter link 316 move rotationally in a counter-clockwise direction and the pin 315 moves in the long hole 313 in an ascending direction. In an ascending process of the pin, since the pin releases the force to press the base 312 in the counter-clockwise direction via the inner wall of the long hole, the base 312 starts to move rotationally in a clockwise direction. Therefore, the shutter piece 157 integrated with the base 312 becomes a retreated state as illustrated in FIG. 17(*c*), to open the outlet 122.

<Banknote Replenishing Operation>

Before setting the paper feed tray 200 in the replenishing box body 101, an operation of setting banknotes of respective denominations on the respective tray pieces of the paper feed tray is performed. The banknote setting operation is started from setting of 10 Yuan banknotes P3 to the lowermost third tray piece 211. Therefore, the tray cover 231, the first tray piece 201, and the second tray piece 211 are integrally opened first to expose the third tray piece, to perform the setting operation. After completion of setting of 10 Yuan banknotes P3 to the third tray piece, setting of 5 Yuan banknotes P2 to the second tray piece and setting of 1 Yuan banknotes P1 to the first tray piece are sequentially performed, and lastly, the tray cover is closed.

The banknote bundles on the respective tray pieces are in a state in which the front ends thereof are aligned, by regulating the position of rear ends thereof in a transport direction by the respective rear-end regulating members 204, 214, and 224. Further, the positions in a width direction thereof are set on a central basis by the side walls of the respective tray pieces.

The paper feed tray 200 having completed setting for respective denominations in this manner is set on the backing plate 170 arranged in the lower unit 120 of the replenishing box body in the opened state as illustrated in FIG. 7. The procedure of setting the paper feed tray on the backing plate is as described with reference to FIG. 15, and one-touch attachment and detachment are possible. Further, fixation by a screw can be also performed.

When the paper feed tray is set in the lower unit 120, it becomes a state as illustrated in FIG. 9, and when the upper unit 130 is closed, it becomes a state as illustrated in FIG. 6(*b*).

In FIG. 6(*b*), the pickup roller 160 comes in contact with the upper surface at the front end in a transport direction of the 1 Yuan banknote bundle P1 located in the uppermost part, and when the pickup roller 160 rotates in a feed direction by driving the motor 152, the uppermost 1 Yuan banknote is fed to the feed route 123, and after the banknote is separated by the separation roller pairs 162 and 154, the banknote is pulled out by the pull roller 155 and discharged from the outlet 122.

After all the 1 Yuan banknotes of the bundle P1 on the first tray piece 201 are fed, the state becomes as illustrated in FIG. 6(*c*), and the pickup roller 160 comes in contact with the upper surface at the front end of the 5 Yuan banknote bundle P2 on the second tray piece 211. When the pickup roller 160 rotates in the feed direction, the uppermost 5 Yuan banknote is fed to the feed route 123 and discharged from the outlet 122.

After all the 5 Yuan banknotes of the bundle P2 on the second tray piece 211 are fed, the pickup roller 160 comes in contact with the upper surface at the front end of the 10 Yuan banknote bundle P3 on the third tray piece 221. When the pickup roller 160 rotates in the feed direction, the uppermost 10 Yuan banknote is fed to the feed route 123 and discharged from the outlet 122.

The banknote after being discharged from the outlet is handled as described with reference to FIG. 4, in such a manner that the banknote passes the recognition unit 15 and is once stacked in the escrow unit 20, and then transported to the circulation-type banknote storage unit corresponding to the denomination thereof or to the collection box.

By setting the banknotes having different sizes on a dedicated tray piece, the posture of respective banknotes in a feed stage can be aligned parallel to the feed direction and the width direction, thereby enabling to prevent paper jam and skew during transport after being fed. Therefore, the occurrence rate of recognition failure in the recognition unit 15 can be considerably decreased.

An operation of storing the 10 Yuan banknotes P3 in the circulation-type drum unit 31 of the circulation-type banknote storage unit 30 while storing the 1 Yuan banknotes P1 and the 5 Yuan banknotes P2 each in the respective circulation-type drum units 41 and 45 in the circulation-type banknote storage unit 40 is as described below.

First, after detaching the circulation-type banknote storage unit 30 from the attachment section 56, the banknote replenishing box is attached to the attachment section thereof and required operations such as connecting a power connector, a signal connector, and the like are completed. In this state, 1 Yuan banknotes and 5 Yuan banknotes are respectively fed to the respective circulation-type drum units 41 and 45 in the circulation-type banknote storage unit 40 in the attachment section 57 from the first and second tray pieces in the banknote replenishing box to complete replenishment. Next, the circulation-type banknote storage unit 40 is replaced by the circulation-type banknote storage unit 30, which is attached in the attachment section 57 without detaching the banknote replenishing box 100, and replenishment of 10 Yuan banknotes is performed from the third tray piece with respect to the circulation-type drum unit 31 in the circulation-type banknote storage unit 30. When replenishment of 10 Yuan banknotes is completed, the banknote replenishing box is detached from the attachment section 56, and by performing a re-attaching operation of the circulation-type banknote storage units 30 and 40 respectively to the original attachment sections 56 and 57, the banknote processing device becomes an operable state. Further, since IDs added to the circulation-type banknote storage units 30 and 40 are respectively managed by a unit ID, as the set position, any of the circulation-type banknote storage units 30 and 40 can be set to any of the attachment sections 56 and 57.

[Summary of Configuration, Action, and Effects of Present Invention]

The paper feed tray 200 according to the first invention is attached to the paper feed device 100 including the feed unit 160 that feeds paper sheets one by one by coming in contact with an upper surface of the paper sheet and rotating. The paper feed tray 200 includes at least the first tray piece 201 on which a plurality of pieces of first paper sheets P1 are placed in a stacked state, the second tray piece 211 arranged immediately below the first tray piece in parallel thereto, on which a plurality of pieces of second paper sheets P2 having a different longitudinal dimension from that of the first paper sheet are placed in a stacked state. The paper feed tray 200 further includes the rear-end regulating members 204 and 214 that respectively regulate rear end positions in a transport direction of a bundle of the first paper sheets and a bundle of the second paper sheets to align front end positions in the transport direction of respective paper sheet bundles to uniform (predetermined) positions, and the width-direction regulating member 216 that regulates positions in a width direction of the bundle of first paper sheets and the bundle of second paper sheets. The configuration is characterized such that after all the first paper sheets in a bundle on the first tray piece have been fed by the feed unit, an uppermost surface of the second paper sheets in a bundle on the second tray piece becomes a state capable of coming in contact with the feed unit.

The paper feed tray can store in a stacked state a plurality of paper sheets (a bundle of paper sheets) having different sizes by separating the paper sheets by size, and starts feed from the paper sheets in the bundle located in an upper position by the feed unit, and after completion of feed of one bundle of paper sheets, feed of the next bundle of paper sheets located immediately below can be performed sequentially and continuously. Since the front end positions in a transport direction of the respective banknote bundles can be aligned to a predetermined position by regulating the rear end positions of the paper sheets in the transport direction by the rear-end regulating members provided in the individual tray pieces, continuous feed by the feed unit becomes possible. Further, since the positions in a width direction of respective banknote bundles can be regulated to predetermined positions by the width-direction regulating member provided in the individual tray piece, highly accurate recognition can be performed when the paper sheet passes the recognition unit after being fed.

There is no limitation in the number of tray pieces, and can be three or four. The size of the paper sheet set in the upper tray piece can be smaller than the banknote on the lower tray piece, or conversely, can be larger.

The banknote bundle on each tray piece projects (overhangs) from a front edge in a transport direction of each tray piece, and comes in contact with each other in a vertical positional relation. Therefore, continuous feed by the feed unit becomes possible.

The paper feed tray 200 according to the second invention is characterized such that each of the tray pieces is coupled with each other at rear ends thereof in a transport direction so as to be able to move rotationally.

The respective tray pieces may be assembled simply in a stacked state; however, by pivotally supporting one end so as to be able to move rotationally, the setting workability and the handling properties of paper sheets can be improved.

The paper feed device 100 according to the third invention is characterized by including the two casings 112 and 114 coupled with each other so as to be openable, the paper feed tray 200 that is detachably set in one casing 112 when the two casings are in an opened state, and the paper feed mechanism 150 that sequentially performs feed of the bundle of first paper sheets and feed of the bundle of second paper sheets by driving the feed unit 160, when the two casings are in a closed state in a state in which the paper feed tray is set therein in a state in which each of the paper sheet bundles is set in each of the tray pieces.

Since such a configuration is adopted that the paper feed tray in which paper sheets having different sizes can be set by size is detachably assembled with respect to the paper feed device, feed of not only one type of paper sheets but also a plurality of types of paper sheets can be performed continuously.

The paper feed device 100 according to the fourth invention is characterized such that the one casing 112 includes the backing plate 170 pivotally supported at one end so as to be able to move rotationally and biased in a projecting direction by the resilient member 181, and the paper feed tray 200 is attached onto the backing plate.

The paper feed tray in which paper sheet bundles are respectively placed on each tray piece is attached to the backing plate that moves rotationally in a vertical direction and is resiliently biased in a projecting direction. Therefore, the paper feed tray is lifted as the remaining number of paper sheets in a bundle decreases due to progress of feed by the feed unit 160, and thus the feed unit can be brought into contact with the upper surface of the banknote bundle on the paper feed tray at all times with a most appropriate feed pressure.

The paper feed device 100 according to the fifth invention is characterized as being a paper sheet replenishing box that is detachably attached to a plurality of the attachment sections 56 and 57 of a circulation-type paper sheet processing device including the attachment sections in which the circulation-type paper sheet storage units 30 and 40 are respectively attached thereto detachably.

There is no limitation in the number of attachment sections. By using the paper feed device as the paper sheet replenishing box, replenishment of paper sheets to a plurality of circulation-type paper sheet storage units can be realized continuously by using one paper sheet replenishing box, thereby enabling to realize improvement in working hours, reduction in work labor, and reduction in management work.

According to the circulation-type paper sheet processing device of the sixth invention, it is possible to obtain the entire advantage of utilizing the paper feed device as a paper sheet replenishing box.

REFERENCE SIGNS LIST

1 banknote (paper sheet) processing device, 3 housing, 5 input/output port, 7 return port, 9*a* each transport route, 9*a* stored-banknote transport route, 9*a* input-banknote transport route, 9*b* stored-banknote transport route, 11 collective deposit unit, 13 centering unit, 15 recognition unit, 20 escrow unit, 21 escrow drum, 22 stacking unit, 24 banknote storage unit, 23 drum, 30 circulation-type banknote storage unit, 31, 35 circulation drum, 40 circulation-type banknote storage unit, 41, 45 each circulation-type drum unit, 50 collection box, 56, 57 attachment section, 100 banknote replenishing box, 101 replenishing box body, 110 casing, 112 lower casing, 114 upper casing, 120 lower unit, 121 shaft support, 122 outlet, 123 feed route, 125 paper-feed tray setting portion, 126 guide holding unit, 126*a* wall, 126*b* groove, 130 upper unit, 135 paper feed tray accommodating unit, 150 paper feed mechanism, 150A lower paper feed mechanism, 150B upper paper feed mechanism, 152 motor, 154 stop roller, 155 pull roller, 157 shutter piece, 160 pickup roller, 162 feed roller, 162, 154 separation roller pair, 164 tension roller, 170 backing plate, 171 bottom plate, 172 shaft hole, 173 front guide holding unit, 173*a* groove, 175 screw hole, 176 slot, 178 pad, 180 rotation shaft, 181 resilient member, 184 backing plate stopper, 190 side guide, 192 end guide, 200 paper feed tray, 201 first tray piece, 202 bottom plate, 202*a* recess, 204, 214, 224 rear-end regulating member, 206 shaft hole, 211 second tray piece, 212 bottom plate, 212*a* recess, 214 rear-end regulating member, 216 side plate, 218 shaft hole, 221 third tray piece, 222 bottom plate, 224 rear-end regulating member, 226 side plate, 227 shaft hole, 228 engagement piece, 229 latch, 231 tray cover, 232 shaft hole, 233 opening, 241 pivot shaft, 251 shaft support, 300 shutter mechanism, 301 frame, 303 solenoid, 304 plunger, 305 coupling piece, 310 shaft portion, 312 base, 313 long hole, 315 pin, 316 shutter link, 317 pivot shaft, 320 spring, 500 control unit

The invention claimed is:

1. A paper feed tray attached to a paper feed device including a pickup roller, wherein the pickup roller is fixed to the paper feed device and configured to feeds paper sheets one by one by coming in contact with an upper surface of a paper sheet and rotating;

the paper feed device comprises resilient member that raises the paper feed tray toward the pickup roller;

the paper feed tray comprising:

at least a first tray piece on which a plurality of pieces of first paper sheets are placed in a stacked state;

a second tray piece arranged immediately below the first tray piece, on which a plurality of pieces of second paper sheets having a different longitudinal dimension from that of the first paper sheets are placed in a stacked state;

rear-end regulating members that respectively regulate rear end positions in a transport direction of a bundle of the first paper sheets and a bundle of the second paper sheets to align front end positions in transport directions of respective paper sheet bundles to predetermined positions; and a width-direction regulating member that regulates positions in a width direction of the bundle of the first paper sheets and the bundle of the second paper sheets;

wherein each of the first tray piece and the second tray piece keeps the bundle of paper sheets placed on the first tray piece and the bundle of paper sheets placed on the second in a non-contact state, except for front edges in the transport direction of the bundle of the paper sheets where the pickup roller contacts the bundle of paper sheets, the first bundle of paper sheets is placed on the first tray piece in a state in which the front edges in the transport direction of the bundle of the paper sheets overhangs from a front edges in the transport direction of the first tray piece in a direction, the second bundle of paper sheets is arranged on the second tray piece in a state in which the first tray piece is not interposed between the top surface of the front edges in the transport direction of the second bundle of paper sheets and the bottom surface of the front edges in the transport direction of the first bundle of paper sheets, wherein after all the first paper sheets in a bundle on the first tray piece have been fed by the pickup roller, the resilient member raises the paper feed tray toward the pickup roller and thereby an uppermost surface of the front edges in the transport direction of the second paper sheets in a bundle on the second tray piece becomes a state capable of coming in contact with the pickup roller; and the paper sheet is one of a banknote, a marketable security and a ticket.

2. The paper feed tray according to claim 1, wherein each of the tray pieces is coupled with each other at rear ends thereof in a transport direction so as to be able to move rotationally.

3. A paper feed device comprising:

two casings coupled with each other so as to be openable;

a paper feed tray that is detachably set in one of the casings when the two casings are in an opened state; and a paper feed mechanism;

wherein, the paper feed tray attached to the paper feed device including a feed unit that feeds paper sheets one by one by coming in contact with an upper surface of a paper sheet and rotating, the paper feed tray comprising:

at least a first tray piece on which a plurality of pieces of first paper sheets are placed in a stacked state;

a second tray piece arranged immediately below the first tray piece, on which a plurality of pieces of second paper sheets having a different longitudinal dimension from that of the first paper sheet are placed in a stacked state;

rear-end regulating members that respectively regulate rear end positions in a transport direction of a bundle of the first paper sheets and a bundle of the second paper sheets to align front end positions in the transport direction of respective paper sheet bundles to predetermined positions; and a width-direction regulating member that regulates positions in a width direction of the bundle of the first paper sheets and the bundle of the second paper sheets, wherein after all the first paper sheets in a bundle on the first tray piece have been fed by the feed unit, an uppermost surface of the second paper sheets in a bundle on the second tray piece becomes a state capable of coming in contact with the feed unit, wherein, the paper feed mechanism sequentially performs feed of the bundle of the first paper sheets and feed of the bundle of the second paper sheets by driving the feed unit, when the two casings are in a closed state in a state in which the paper feed tray is set therein in a state in which each of the paper sheet bundles is set in each of the tray pieces.

4. The paper feed device according to claim 3, wherein the one of the casings includes a backing plate pivotally supported at one end so as to be able to move rotationally and biased in a projecting direction by a resilient member, and the paper feed tray is attached onto the backing plate.

5. The paper feed device according to claim 3, wherein the paper feed device is a paper sheet replenishing box that is detachably attached to a plurality of attachment sections of a circulation-type paper sheet processing device including the attachment sections in which a circulation-type paper sheet storage unit is each attached detachably.

6. A circulation-type paper sheet processing device comprising the paper feed device according to claim 3.

* * * * *